US010222179B2

(12) United States Patent
Smith et al.

(10) Patent No.: US 10,222,179 B2
(45) Date of Patent: Mar. 5, 2019

(54) BACKUP GUNSIGHTS

(71) Applicant: Vista Outdoor Operations LLC, Farmington, UT (US)

(72) Inventors: Paul N. Smith, Bozeman, MT (US); Robert J. Meinert, Andover, MN (US); Troy E. Lance, Livingston, MT (US); Christopher D. Laack, Kansas City, MO (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 16/037,338

(22) Filed: Jul. 17, 2018

(65) Prior Publication Data

US 2019/0017784 A1 Jan. 17, 2019

Related U.S. Application Data

(60) Provisional application No. 62/533,401, filed on Jul. 17, 2017.

(51) Int. Cl.

| | |
|---|---|
| ***F41G 1/033*** | (2006.01) |
| ***F41G 1/08*** | (2006.01) |
| ***F41G 11/00*** | (2006.01) |
| ***F41G 3/08*** | (2006.01) |
| ***F41G 1/16*** | (2006.01) |

(52) U.S. Cl.

CPC ..... *F41G 11/003* (2013.01); *F41G 1/033* (2013.01); *F41G 1/08* (2013.01); *F41G 1/16* (2013.01); *F41G 3/08* (2013.01)

(58) Field of Classification Search

CPC ... F41G 1/033; F41G 1/08; F41G 1/02; F41G 1/17; F41G 1/06; F41G 1/16

USPC ..... 42/136, 140, 137, 147, 148

See application file for complete search history.

(56) References Cited

U.S. PATENT DOCUMENTS

| | | | | |
|---|---|---|---|---|
| 5,533,292 | A | 7/1996 | Swan | |
| 6,732,467 | B1 * | 5/2004 | Luth | F41G 1/16 42/138 |
| D507,620 | S | 7/2005 | Swan | |
| D526,380 | S | 8/2006 | Swan | |
| D548,811 | S | 8/2007 | Swan | |
| D556,290 | S | 11/2007 | Swan | |
| D586,875 | S | 2/2009 | Swan | |
| D588,228 | S | 3/2009 | Swan | |
| D588,672 | S | 3/2009 | Swan | |
| D594,083 | S | 6/2009 | Mayberry et al. | |

(Continued)

*Primary Examiner* — Reginald S Tillman, Jr.

(74) *Attorney, Agent, or Firm* — Christensen, Fonder, Dardi & Herbert PLLC

(57) ABSTRACT

A gunsight system for aiming a firearm is disclosed. The gunsight system includes a front sight and a rear sight. The firearm has a barrel defining a bore that extends along a gun bore axis. The gun bore axis extends in a forward direction and a rearward direction. The front sight comprises a front sight post including a front sighting element. The rear sight comprises a rear sight post including a rear sighting element. Each sight post is pivotable between a deployed position and a reclined position. When the sight post are in the deployed position, the user may aim the firearm with reference to a sight line extending through the front and rear sighting elements. The sight line and the gun bore axis may be generally parallel to one another when the sight arms are in the deployed position.

20 Claims, 22 Drawing Sheets

(56) References Cited

U.S. PATENT DOCUMENTS

| | | | | |
|---|---|---|---|---|
| D594,084 | S | 6/2009 | Mayberry et al. | |
| D600,311 | S | 9/2009 | Swan | |
| D600,312 | S | 9/2009 | Swan | |
| D602,556 | S | 10/2009 | Swan | |
| D604,794 | S | 11/2009 | Bentley | |
| D614,723 | S | 4/2010 | Bentley | |
| D615,144 | S | 5/2010 | Mayberry et al. | |
| D631,124 | S | 1/2011 | Ballard | |
| D635,634 | S | 4/2011 | Swan | |
| D637,259 | S | 5/2011 | Swan | |
| D637,260 | S | 5/2011 | Swan | |
| D637,261 | S | 5/2011 | Swan | |
| 8,015,744 | B1 * | 9/2011 | Swan | F41G 1/065 42/133 |
| D648,413 | S | 11/2011 | Mayberry et al. | |
| D657,013 | S | 4/2012 | Swan | |
| D666,689 | S | 9/2012 | Swan | |
| 8,484,882 | B2 | 7/2013 | Haley et al. | |
| D687,915 | S | 8/2013 | Adcock, Jr. | |
| D692,088 | S | 10/2013 | Swan | |
| D697,576 | S | 1/2014 | Swan et al. | |
| D705,890 | S | 5/2014 | Fitzpatrick et al. | |
| D724,691 | S | 3/2015 | Barfoot et al. | |
| D728,727 | S | 5/2015 | Barfoot et al. | |
| D728,728 | S | 5/2015 | Barfoot et al. | |
| D736,338 | S | 8/2015 | Fitzpatrick et al. | |
| D736,339 | S | 8/2015 | Fitzpatrick et al. | |
| 9,285,186 | B1 | 3/2016 | DiVeroli et al. | |
| 9,733,045 | B1 * | 8/2017 | Bozek | F41G 1/16 |
| 9,835,411 | B2 * | 12/2017 | Larson, Jr. | F41G 11/003 |
| 2011/0247257 | A1 * | 10/2011 | Hopkins | F41G 1/08 42/133 |
| 2011/0308132 | A1 * | 12/2011 | Hewes | F41G 1/033 42/135 |
| 2011/0308133 | A1 * | 12/2011 | Nemec | F41G 1/16 42/137 |
| 2016/0102941 | A1 * | 4/2016 | Brucker | F41G 1/17 42/148 |
| 2017/0350674 | A1 * | 12/2017 | Odle | F41G 1/01 |

* cited by examiner

BACKUP GUNSIGHTS

CROSS-REFERENCE TO RELATED APPLICATION

This application claims the benefit of U.S. Provisional Application No. 62/533,401, filed Jul. 17, 2017, the disclosure of which is incorporated by reference herein.

BACKGROUND OF THE DISCLOSURE

Weapon-mounted firearm accessories have become an important tool for military, police, and civilian firearm users. Many firearm designs incorporate mounting rails for supporting these accessories, for example, rifles known as Modern Sporting Rifles. Using an accessory rail interface, a given accessory may be mounted to a variety of firearms or firearms platforms. Likewise, if a particular firearm includes a rail interface, a variety of accessories may be interchangeably mounted to the firearm. The interchangeability of accessories is of particular importance to military and law enforcement personnel attached to special operations units, as this allows a single firearm to be reconfigured to meet certain mission specific needs.

A number of rail-mounted firearm accessories can be used to facilitate aiming the weapon. Examples of such popular accessories for aiming a firearm include laser sighting devices, optical sighting devices such as riflescopes, and reflex sights. Laser sights project a laser light beam onto a target and can aid in shooting accuracy and speed, particularly in high pressure situations or when shooting at night or indoors in poorly lit environments. Although laser sights work well in low light conditions, in bright light conditions ambient light can easily overwhelm the dot generated on the target by the laser light source, making the dot difficult or impossible for the user to see. A laser sight also uses a relatively large amount of power, so the battery life for a laser sight is typically relatively short. Also, as with other sights, a laser sight is adjusted or sighted for a particular distance and wind condition. In some combat situations, the laser beam from a laser sight may also act as a targeting beacon for an adversary.

Reflex sights, also known in the art as a reflector sights or red dot sights, allows the user to look through a partially reflecting glass element and see an illuminated projection of an aiming point or reticle superimposed on the field of view The sighting devices above and other sighting devices incorporate electronic components and are battery powered. When this is the case, the sighting device will fail to fully function if the battery drains or the electronic components fail. It is common for owners of modern sporting rifles to have on the upper rail, mounted back up iron sights as a further accessory for use in the event of failure of the laser, reflex or telescopic sight, or simply when it is not convenient or there is not time to use these sights.

Back up iron sights have a front post sight and a rear apertured windage sight, both individually mounted to the rail by way of a base with a clamp portion that adjustably clamps to the rail. A sight portion is often pivotally hinged to the base so that the sight portion may be laying along the rail when not in use and may be flipped-up for use. The sight portion being either a front sight post assembly or a rear apertured sight assembly.

The rear windage sight typically has a flippable rear sighting element having a first sight apertured portion and a second sight apertured portion, the element rotatable to allow positioning of one of the two apertured portions in the line of sight. Typically mechanical detents in the pivot connection secure the element in one or the other position.

Such back up iron sights are typically not made of iron as the name implies but are made either primarily or exclusively from metal or primarily from polymers. Polymer backup iron sights have the principle components injection molded providing an inexpensive product that may have the appearance of metal, a good "feel" due to polymers being softer and having less heat capacity than metals. Polymer backup iron sights are also lighter than metal, which is considered desirable by many users, and can also provide some shock absorption of minor impacts. Polymer bases that clamp to rails are less likely to damage (scuff, scratch, dent) the metal rails. Also, due to the resilience of polymers, a polymer rail clamp portion may be formed of a single injection molded piece that can, by way of the flexibility of polymer, be clamped to the rail by a tightening screw. There is a perception that polymer iron sights do not hold their adjustments as well as metal iron sights. Also polymer components may be damaged upon severe impact, their performance may deteriorate with extensive use and wear, and the polymer material may deteriorate over time. There is a perception that polymer backup iron sights have lesser quality.

When formed of metal the various components of the sights are generally stronger, more durable, generally will not deteriorate, and are perceived to hold their sight adjustment better. However the metal components of backup iron sights must be intricately machined, coated or painted, and assembled generally making all metal backup iron sights more expensive that such sights with the main components injection molded.

Any improvements to cost, function, durability of backup iron sights would be welcomed by consumers and manufacturers.

SUMMARY

In embodiments, a backup gunsight system for aiming a firearm includes a front sight and a rear sight each having a polymer base portion with a clamp portion for attachment to a rail, such as Picatinny rail, of a firearm. The forward sight has a front sight assembly with adjustable elevation post assembly pivotally attached to the base portion and being pivotal between an upright position and a reclined position. The rear sights having a rear sight aperture assembly pivotally attached to the respective base portion and being pivotal between an upright position and a reclined position.

In embodiments, the rear sight aperture assembly comprises a rear polymer support body having a U-shape with two upright legs and defining a slot, a rear metal insert with a U-shape and two upright legs nested in the slot, and a metal rear sighting element having a first sight apertured portion and a second sight apertured portion being pivotally supported on a threaded rod between the upright legs of the respective legs. The metal rear sighting element flippable between a first position with the first sight apertured portion upright and a second position with the second sight apertured portion upright. A manual knob can rotate the rod to adjust windage. In embodiments, a magnet is disposed in a magnet opening defined by the rear metal insert to retain the metal rear sighting element in either of the first position and second position.

A feature and advantage of embodiments is that a good feel is provided by the polymer support portions on both the front and rear sights. The good feel provided by the polymer surface having a lesser heat capacity and having a softer feel.

That is, the polymer support portions don't seem as cold to the touch. In embodiments, the metal components are nested within polymer components, thereby minimizing any contact with the metal components.

A feature and advantage of embodiments is that metal components are utilized for the movable components, particularly the apertured element and windage adjustment components of the rear sight and the post and elevation adjustment components of the front sight. Use of metal components provide enhanced wear compared to polymer components.

A feature and advantage of embodiments is that the apertured sight element is held in one of two sight positions by a magnet, eliminating wear surfaces associated with a conventional detent mechanism.

DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

In FIG. 15A, a rearward portion of the rod can be seen extending into a deployed position groove defined by the front sight post.

In FIG. 15B, a rearward portion of the rod can be seen extending into a reclined position groove defined by the front sight post.

Figure 1B:
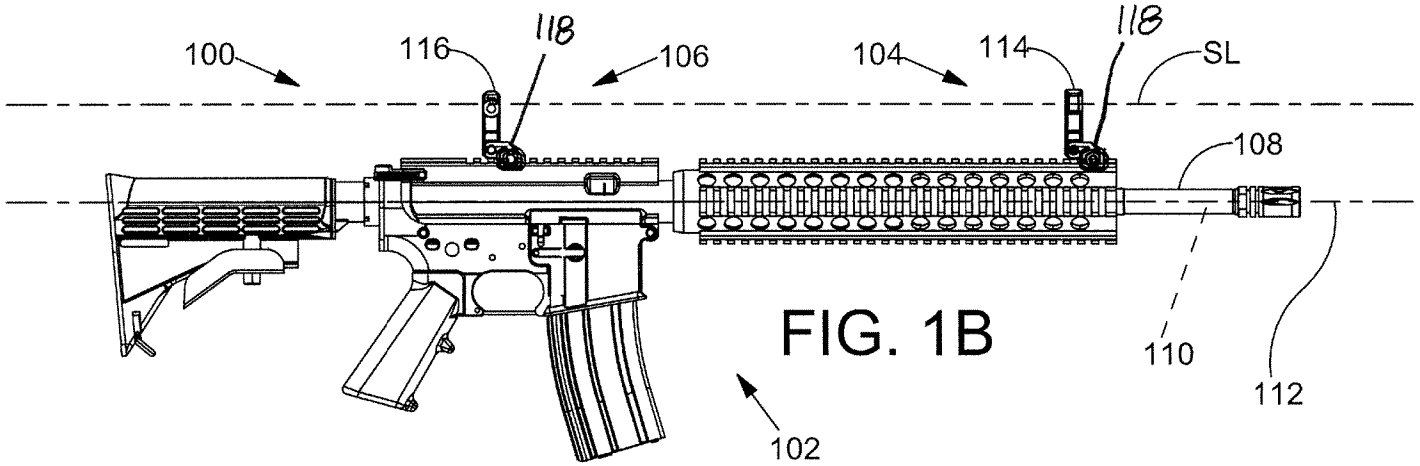
FIG. 1A and FIG. 1B are side views showing an example firearm and a gunsight system for aiming the firearm.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 1A:
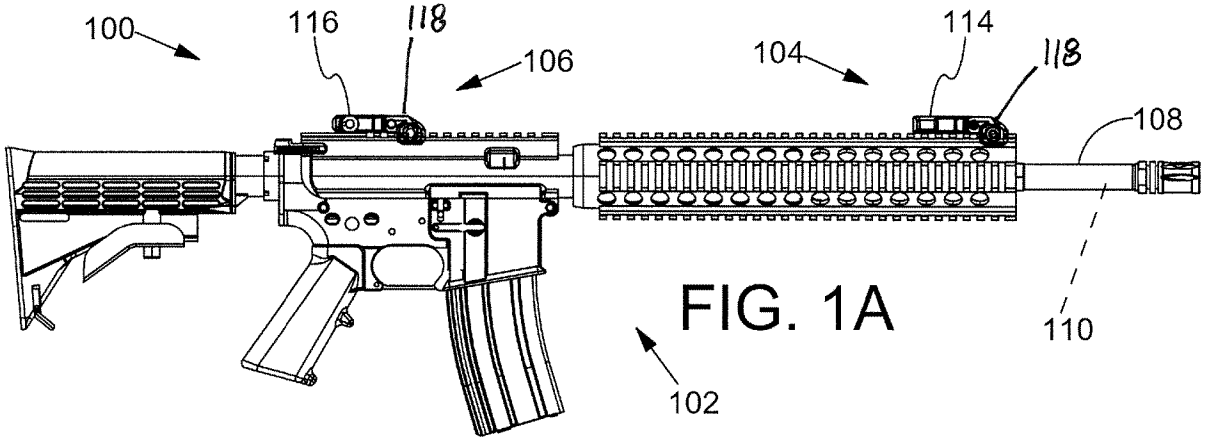

Referring to FIG. 1A and FIG. 1B, side views of a backup iron sight gunsight system 100 for mounting to a Picatinny rail 101 of a firearm 102 are shown. The gunsight system 100 includes a front sight 104 with an adjustable elevation post and a rear sight 106 with adjustable windage. The firearm 102 has a barrel 108 defining a bore 110 with a gun bore axis 112. The front sight 104 comprises a front sight portion 114 including a sighting post, not shown in this view, the sight portion mounted on a base 118. The rear sight 106 comprises a rear sight portion 116 pivotably mounted to a base 118. Each sight portion is pivotable between a deployed position and a reclined position. When the sight portion are in the deployed position, the user may aim the firearm with reference to a sight line SL extending through the front and rear sighting elements. As shown in FIG. 1, the sight line SL and the gun bore axis 112.

Figure 2:
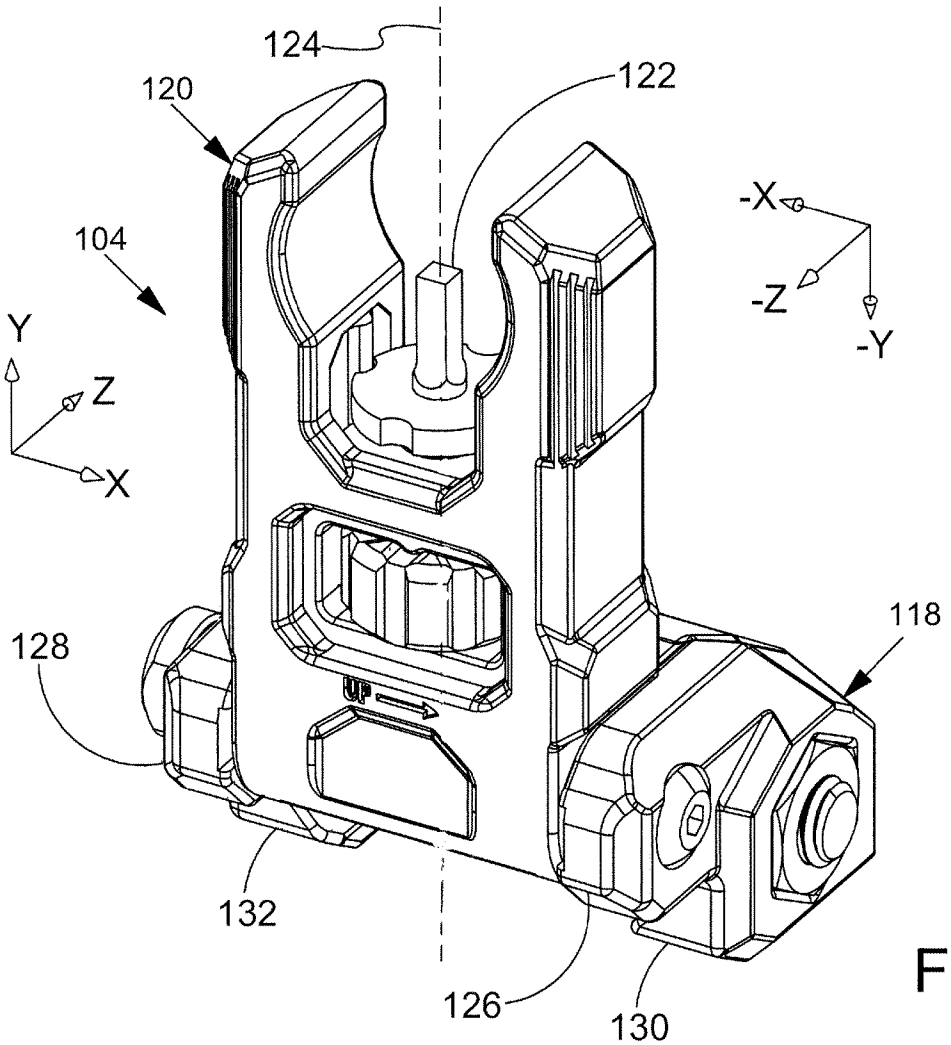
FIG. 2 is a perspective view showing a front sight in accordance with the detailed description.

Referring to FIG. 2, a perspective view of a front sight 104 is shown. The front sight 104 comprises the base 118 having two rearwardly extending arms pivotally supporting a front sight post assembly 120. The front sight post assembly 120 includes a front sighting element 122 configured as a post 122. The front sight post assembly 120 is selectively pivotable about a sight post pivot axis PA between a deployed position and a reclined position. The two rearwardly extending arms of the base 118 include a starboard side arm 126 and a port side arm 128. The base 118 also includes two downwardly extending legs for coupling the base 118 to a mounting rail 198. The two downwardly extending legs of the base include a starboard side leg 130 and a port side leg 132.

Figure 3:
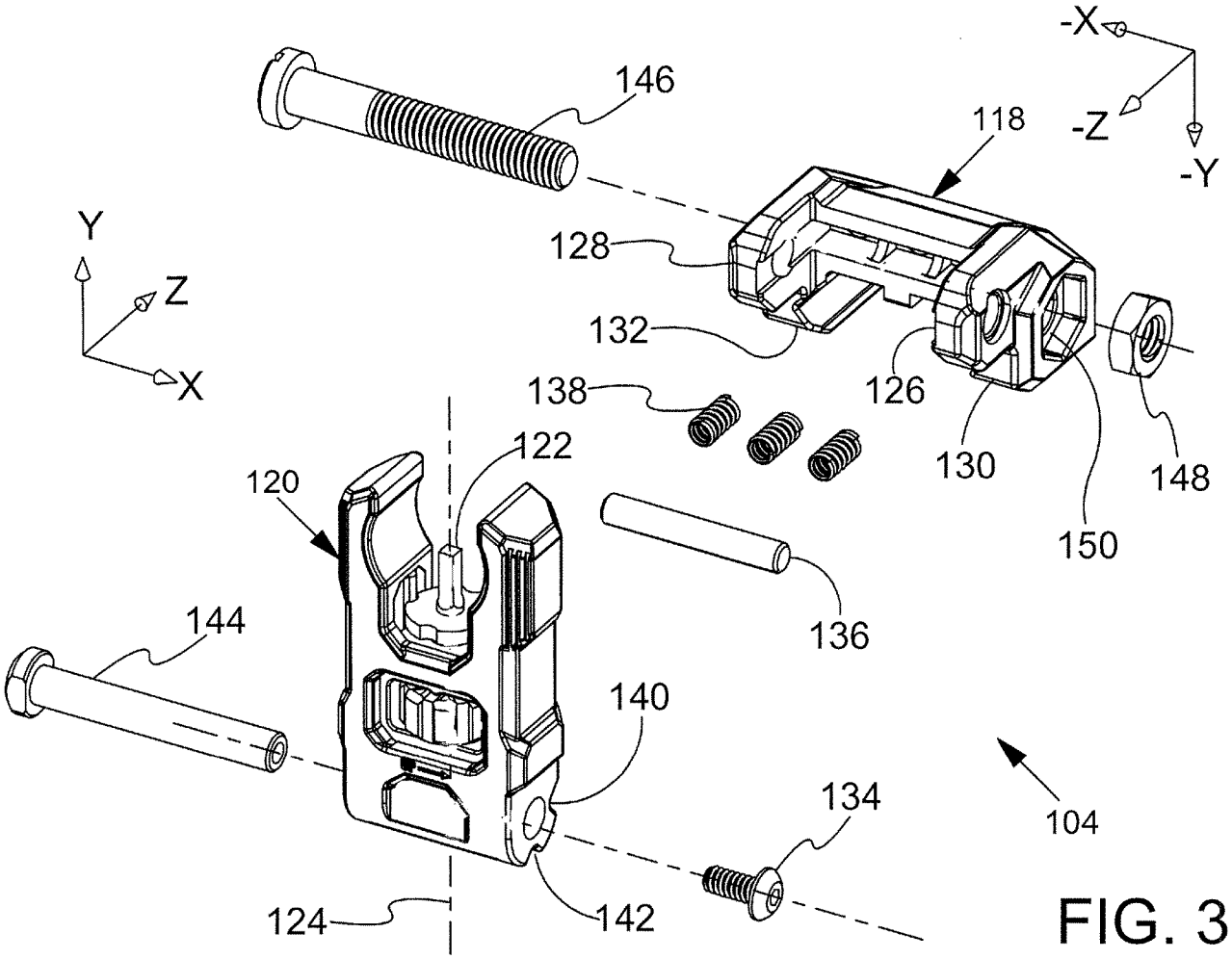
FIG. 3 is an exploded perspective view of the front sight shown in FIG. 2.

Referring to FIG. 3, an exploded perspective view of the front sight 104 of FIG. 2 is shown. The front sight 104 comprises a base 118 having a starboard side arm 126 and a port side arm 128. The starboard side arm 126 and the port side arm 128 pivotally support a front sight post assembly 120 when the front sight 104 is in an assembled state. A shaft 144 of the front sight 104 may extend through the starboard side arm 126 of the base 118, the front sight post assembly 120 and the port side arm 128 of the base 118. A retaining screw 134 may threadingly engage a threaded hole in the shaft 144 to prevent the shaft 144 from separating from the base 118 of the front sight post assembly.

Still referring to FIG. 3, the front sight post assembly 120 is selectively pivotable about a sight post assembly pivot axis PA between a deployed position and a reclined position. A rod 136 of the front sight 104 is urged toward the front sight post assembly 120 by three springs 138. The front sight post assembly 120 defines a deployed position groove 140 and a reclined position groove 142. The rod 136 is received in the deployed position groove 140 when the front sight post assembly 120 is in the deployed position. The front sight post assembly 120 comprises a front sighting element 122 extending along a front sighting element axis 124. The front sighting element axis 124 extends in the upward and downward directions when the front sight post assembly 120 is in the deployed position. The rod 136 is received in the reclined position groove 142 when the front sight post assembly 120 is in the reclined position.

Still referring to FIG. 3, the base 118 of the front sight 104 includes two downwardly extending legs for coupling the base 118 to a mounting rail 198. The two downwardly extending legs of the base include a starboard side leg 130 and a port side leg 132. A bolt 146 extends through a port side hole defined by the port side leg 132 and a starboard side hole defined by the starboard side leg 130. The bolt 146 threadingly engages a nut 148. The nut 148 is receive in a hex shaped receptacle 150 defined by the base 118. Forces applied to the base 118 by the bolt 146 and the nut 148 may deflect the base 118 so that the front sight 104 is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118.

Figure 4:
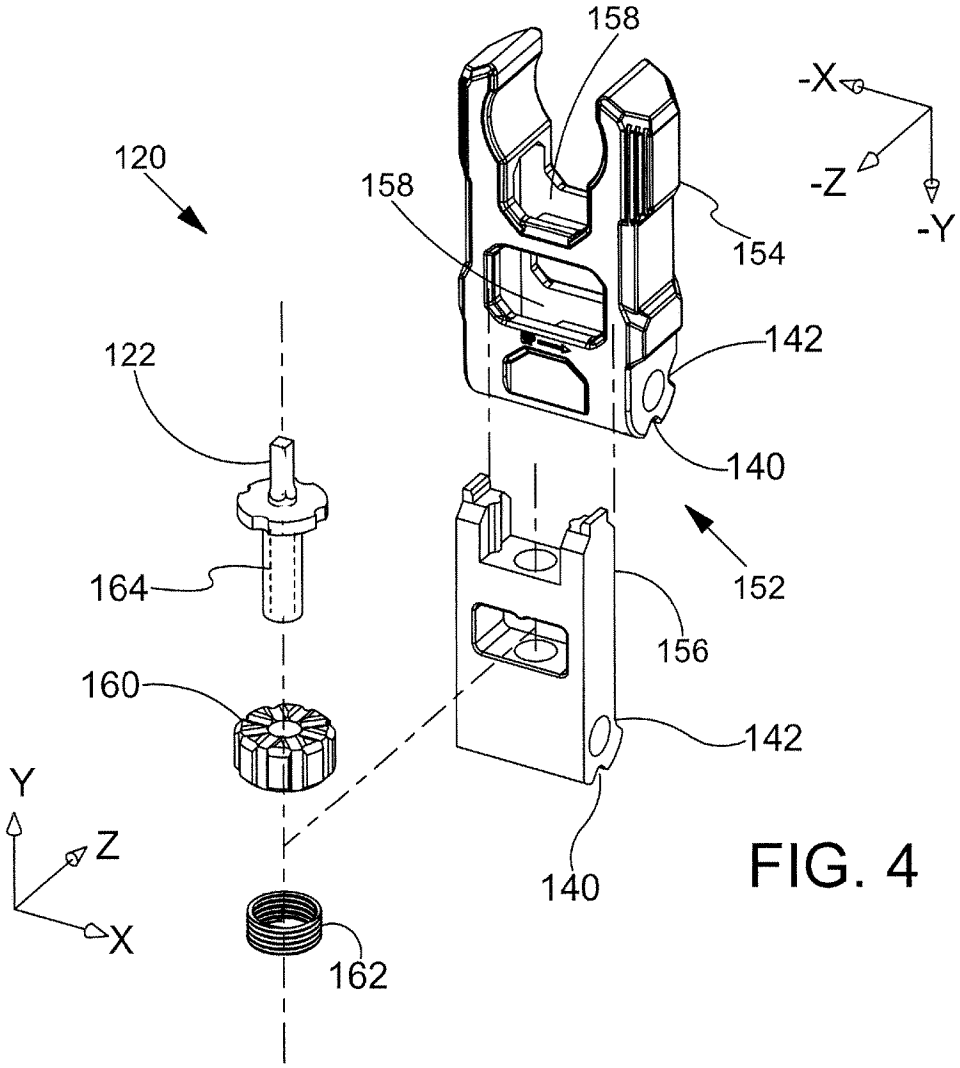
FIG. 4 is an exploded perspective view of the front sight post assembly shown in FIG. 3.

Referring to FIG. 4, an exploded perspective view of the front sight post assembly 120 of FIG. 3 is shown. The front sight post assembly 120 comprises a front support 152 including a polymer front support body 154 and a metal front insert 156. When the front support 152 is assembled, the front insert is disposed inside a cavity 158 defined by the front support body 154. In embodiments, the front insert 156 comprises metal and the front support body 154 comprises a thermoplastic polymer material. In these embodiments, the front support 152 may be manufactured using an insert molding process. The front support body 154 and the front post insert 156 each define a portion of a deployed position groove 140 and a portion of a reclined position groove 142.

Still referring to FIG. 4, the front sight post assembly 120 includes a front sighting element 122 configured as a post and an elevation rotatable knob or dial 160. The front sighting element 122 has a front sighting element axis 124 and the rotatable knob 160 may be rotated to move the front sighting element 122 upward and downward along the front sighting element axis 124. A threaded insert 162 is fixed to the rotatable knob 160 when the knob 160 is in an unexploded state. The threaded insert 162 of the elevation knob 160 may threadingly engage a sighting element thread 164 of the front sighting element 122.

Figure 5:
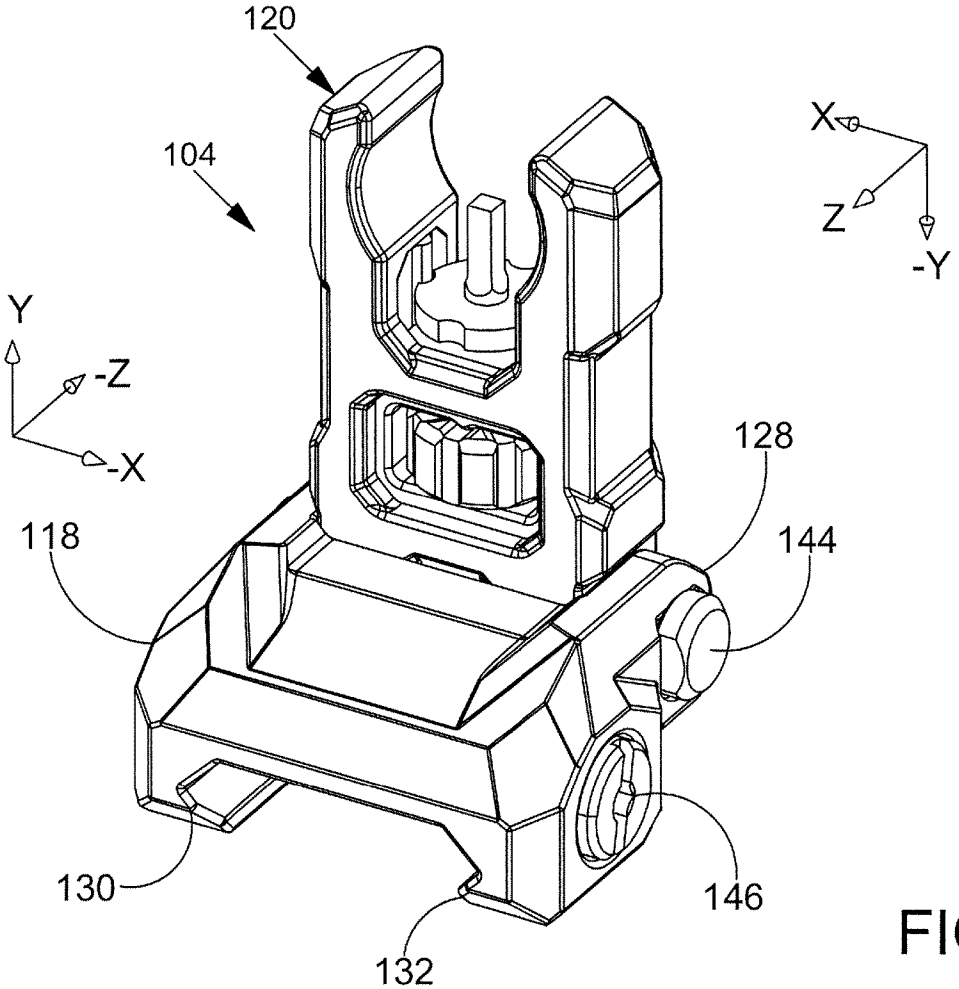
FIG. 5 is a perspective view illustrating additional sides of the front sight shown in FIG. 2.

Referring to FIG. 5, a perspective view illustrating additional sides of the front sight 104 of FIG. 2 is shown. The front sight 104 shown in FIG. 5 is rotated approximately 180 degrees relative to the front sight 104 shown in FIG. 2. The front sight 104 comprises a base 118 having two downwardly extending legs or clamp portions 130, 132 for coupling the base 118 to a mounting rail 198. The two downwardly extending legs of the base include a starboard side leg 130 and a port side leg 132. A bolt 146 extends through a port side hole defined by the port side leg 132 and a starboard side hole defined by the starboard side leg 130. Forces applied to the base 118 by the bolt 146 may deflect the base 118 so that the front sight is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118. The base 118 of the front sight 104 also includes a port side arm 128 and a starboard side arm 126 (seen in FIG. 2). A shaft 144 of the front sight 104 may extend through the starboard side arm 126 of the base 118, the front sight post assembly 120 and the port side arm 128 of the base 118. The shaft 144 of the front sight 104 pivotally supports the front sight post assembly 120 in the embodiment of FIG. 5.

Figure 6:
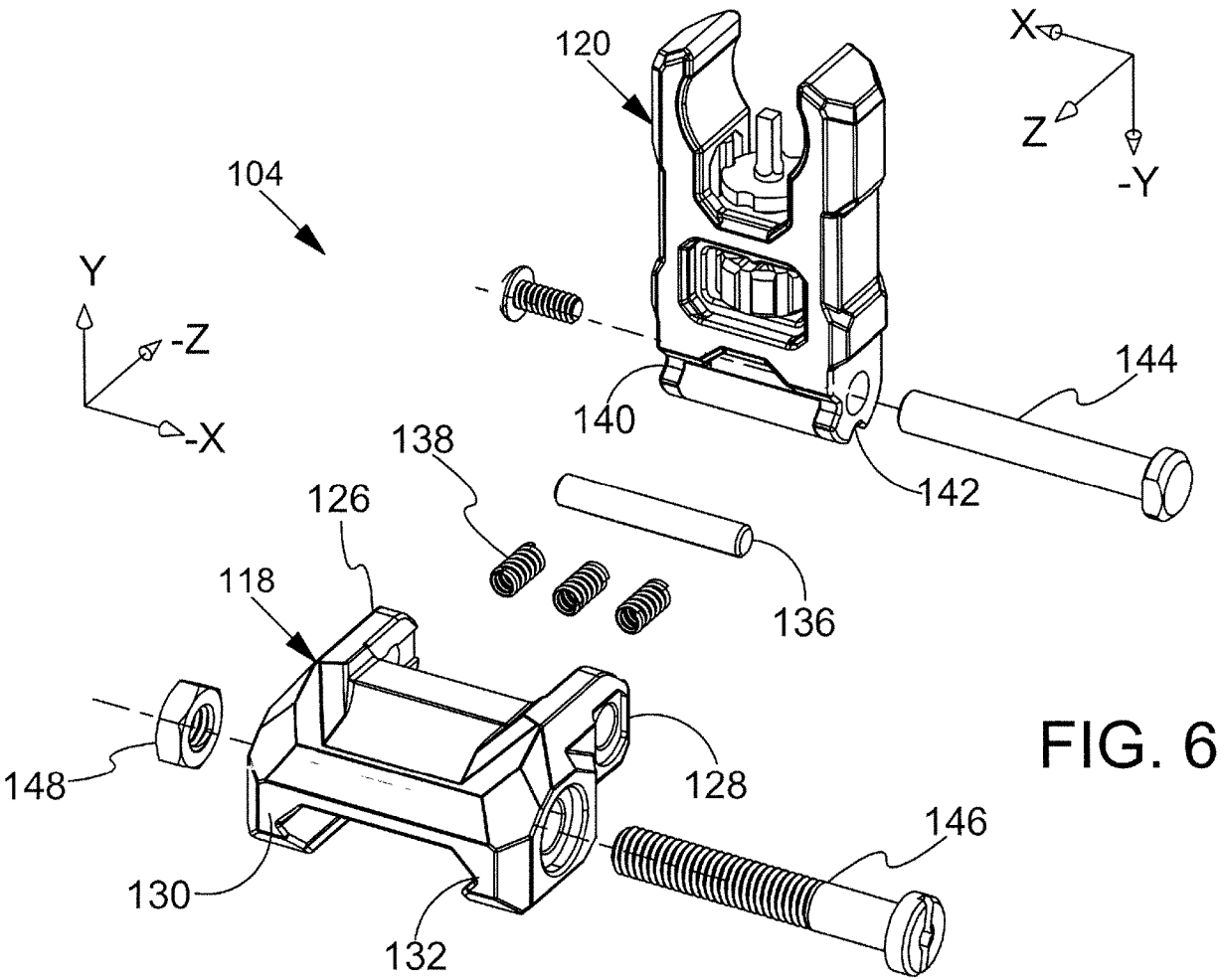
FIG. 6 is an exploded perspective view of the front sight shown in FIG. 5.

Referring to FIG. 6, an exploded perspective view of the front sight 104 of FIG. 5 is shown. The front sight 104 comprises a front sight post assembly 120 and a base 118. The base 118 has two downwardly extending legs and two rearwardly extending arms. The two downwardly extending legs of the base include a starboard side leg 130 and a port side leg 132. A bolt 146 may extend through a port side hole defined by the port side leg 132 and a starboard side hole defined by the starboard side leg 130. The bolt 146 threadingly engages a nut 148. Forces applied to the base 118 by the bolt 146 and the nut 148 may deflect the base 118 so that the front sight is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118.

Still referring to FIG. 6, the two rearwardly extending arms of the base include a starboard side arm 126 and a port side arm 128. A shaft 144 of the front sight 104 may extend through the starboard side arm 126 of the base 118, the front sight post assembly 120 and the port side arm 128 of the base 118. A retaining screw 134 may threadingly engage a threaded hole in the shaft 144 to prevent the shaft 144 from separating from the base 118 of the front sight 104. The shaft 144, the starboard side arm 126 and the port side arm 128 may pivotally support a front sight post assembly 120 when the front sight 104 is in an assembled state.

Still referring to FIG. 6, the front sight post assembly 120 is selectively pivotable about a sight post pivot axis PA between a deployed position and a reclined position. A rod 136 of the front sight 104 is urged toward the front sight post assembly 120 by three springs 138. The front sight post assembly 120 defines a deployed position groove 140 and a reclined position groove 142. The rod 136 is received in the deployed position groove 140 when the front sight post assembly 120 is in the deployed position. The rod 136 is received in the reclined position groove 142 when the front sight post assembly 120 is in the reclined position.

Figure 7:
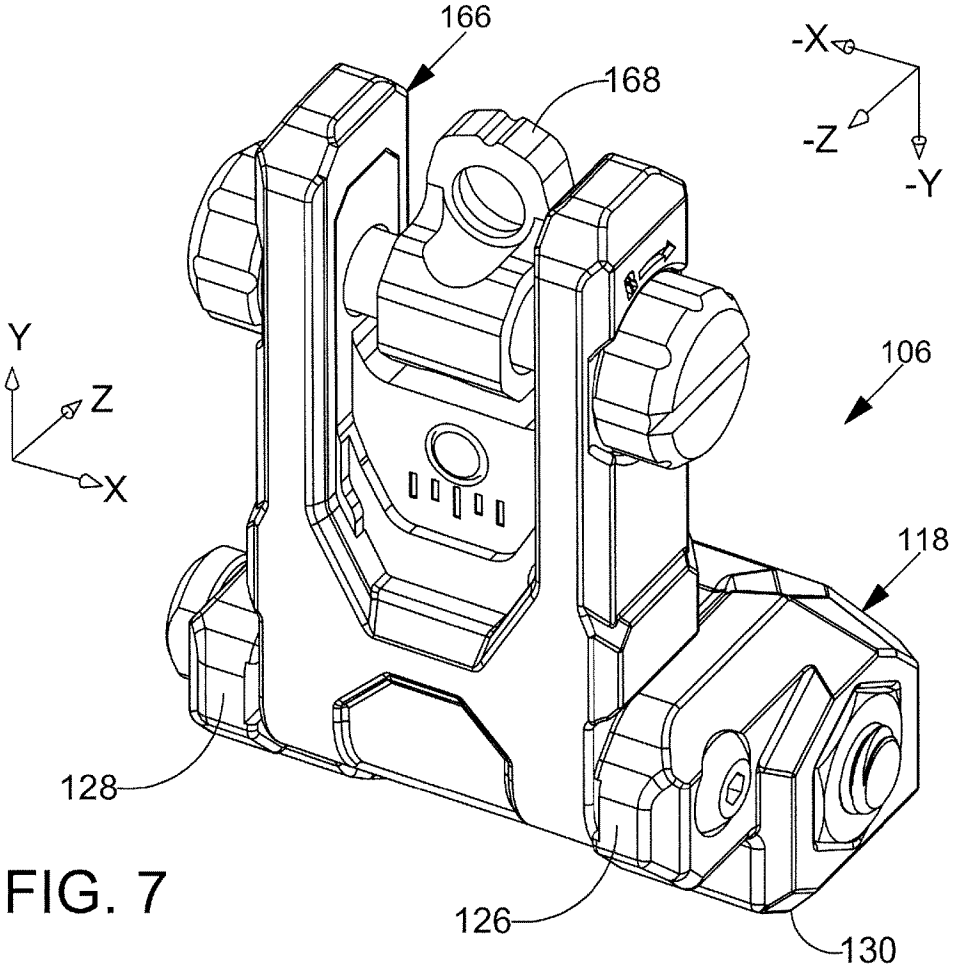
FIG. 7 is a perspective view of a rear sight.

Referring to FIG. 7, a perspective view of a rear sight 106 is shown. The rear sight 106 comprises a base 118 having two rearwardly extending arms pivotally supporting a rear apertured sight assembly 166. The rear apertured sight assembly 166 includes a rear sighting element 168. The rear sighting element defines a first aperture and a second aperture. The rear apertured sight assembly 166 is selectively pivotable about a sight post pivot axis PA between a deployed position and a reclined position. The two rearwardly extending arms of the base 118 include a starboard side arm 126 and a port side arm 128. The base 118 also includes two downwardly extending legs for coupling the base 118 to a mounting rail 198. The two downwardly extending legs of the base include a starboard side leg 130 and a port side leg 132.

Figure 8:
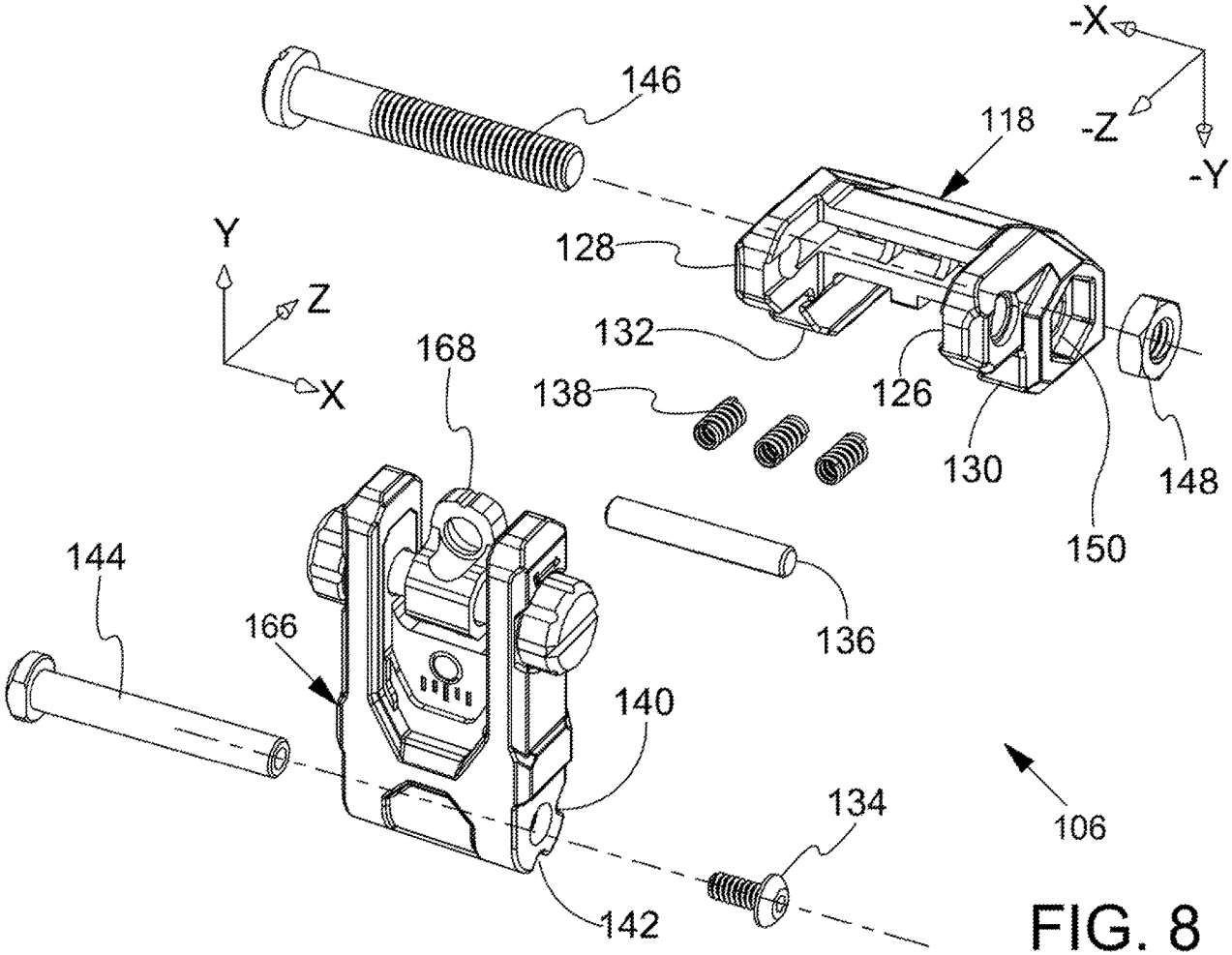
FIG. 8 is an exploded perspective view of the rear sight shown in FIG. 7.

Referring to FIG. 8, an exploded perspective view of the rear sight 106 of FIG. 7 is shown. The rear sight 106 comprises a base 118 having a starboard side arm 126 and a port side arm 128. A shaft 144 of the rear sight 106 may extend through the starboard side arm 126 of the base 118, the rear apertured sight assembly 166 and the port side arm 128 of the base 118. The shaft 144, the starboard side arm 126 and the port side arm 128 pivotally support a rear apertured sight assembly 166 when the rear sight 106 is in an assembled state. A retaining screw 134 may threadingly engage a threaded hole in the shaft 144 to prevent the shaft 144 from separating from the base 118 of the rear apertured sight assembly.

Still referring to FIG. 8 the rear apertured sight assembly 166 is selectively pivotable about a sight post pivot axis PA between a deployed position and a reclined position. A rod 136 of the rear sight 106 is urged toward the rear apertured sight assembly 166 by three springs 138. The rear apertured sight assembly 166 defines a deployed position groove 140 and a reclined position groove 142. The rod 136 is received in the deployed position groove 140 when the rear apertured sight assembly 166 is in the deployed position.

Still referring to FIG. 8, the base 118 of the rear sight 106 includes two downwardly extending legs for coupling the base 118 to a mounting rail 198. The two downwardly extending legs of the base include a starboard side leg 130 and a port side leg 132. A bolt 146 extends through a port side hole defined by the port side leg 132 and a starboard side hole defined by the starboard side leg 130. The bolt 146 threadingly engages a nut 148. The nut 148 is receive in a hex shaped receptacle 150 defined by the base 118. Forces applied to the base 118 by the bolt 146 and the nut 148 may deflect the base 118 so that the rear sight 106 is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118.

Figure 9:
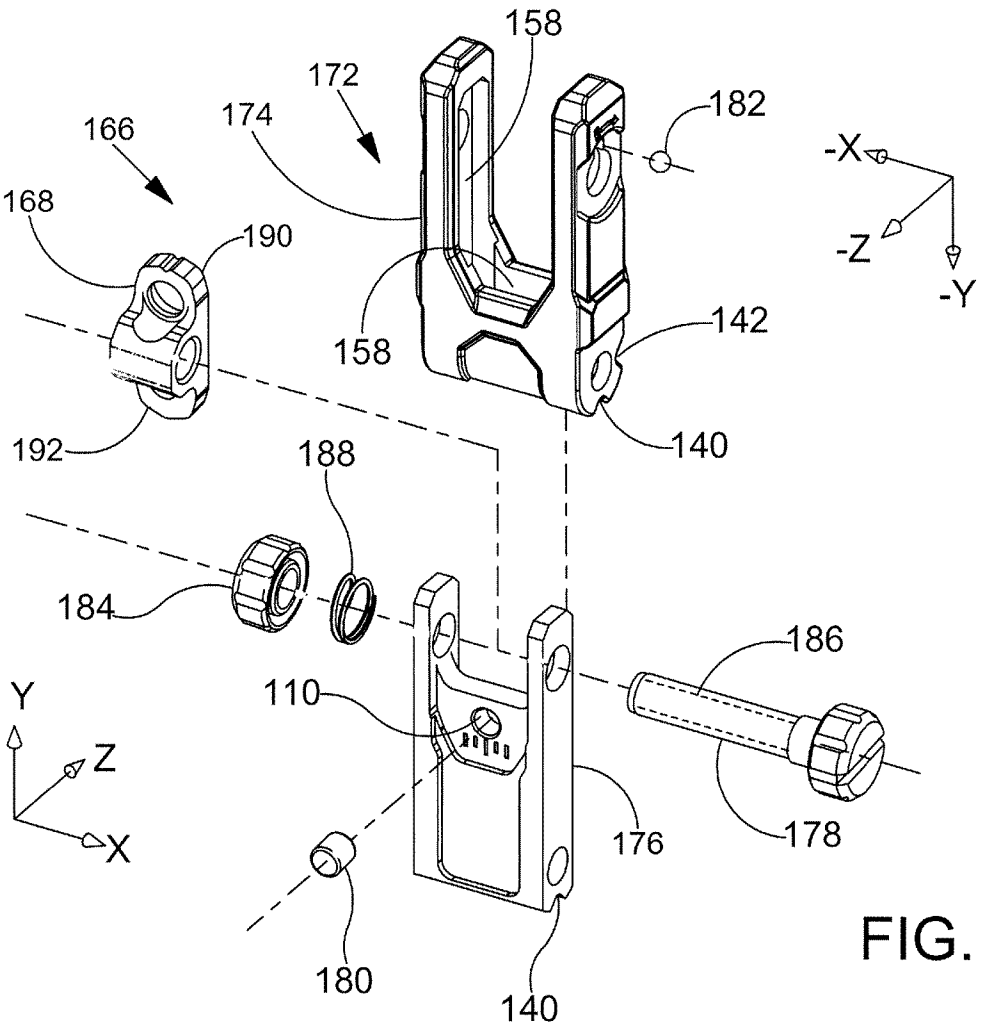
FIG. 9 is an exploded perspective view of the rear apertured sight assembly shown in FIG. 8.

Referring to FIG. 9, an exploded perspective view of the rear apertured sight assembly 166 of FIG. 8 is shown. The rear apertured sight assembly 166 comprises a rear support 172 including a rear support body 174 and a rear insert 176. When the rear support 172 is in an unexploded state, the rear insert 176 is disposed inside a cavity 158 defined by the rear support body 174. In embodiments, the rear insert 176 comprises metal or a metallic material and the rear support body 174 comprises a thermoplastic polymer material. In these embodiments, the rear support 172 may be manufactured using an insert molding process. The rear support body 174 and the rear insert 176 each define a portion of a deployed position groove 140 and a portion of a reclined position groove 142.

Still referring to FIG. 9, the rear apertured sight assembly 166 includes a rear sighting element 168 defining a first aperture and a second aperture. The rear sighting element 168 is pivotally supported by a windage screw 178. The rear sighting element 168 is free to pivot between a first position and a second position that is approximately 180 degrees different from the first position. The magnet 180 is positioned to retain the rear sighting element 168 in both the first position and the second position. A magnet 180 is located in a magnet aperture 110, such as a bore, in the rear insert 176 when the rear sight post 116 is in an assembled state. When the rear sighting element 168 is in the first position, the first aperture is located above the second aperture. When the rear sighting element 168 is in the second position, the sighting position, the second aperture is located above the first aperture.

Still referring to FIG. 9, a detent ball 182 is trapped between an outer surface of the rear support body 174 and the head portion of the windage screw 178 when the rear sight post 116 is in an assembled state. A windage cap 184 threadingly engages a windage thread 186 of the windage screw 178. A windage spring 188 is partially received in a circular groove defined by the windage cap 184. A first end of the windage spring 188 is seated against the windage cap 184 and a second end of the windage spring 188 is seated against an outer surface of the rear support body 174. The windage spring 188 applies a spring force between the windage cap 184 and the outer surface of the rear support body 174.

Figure 10:
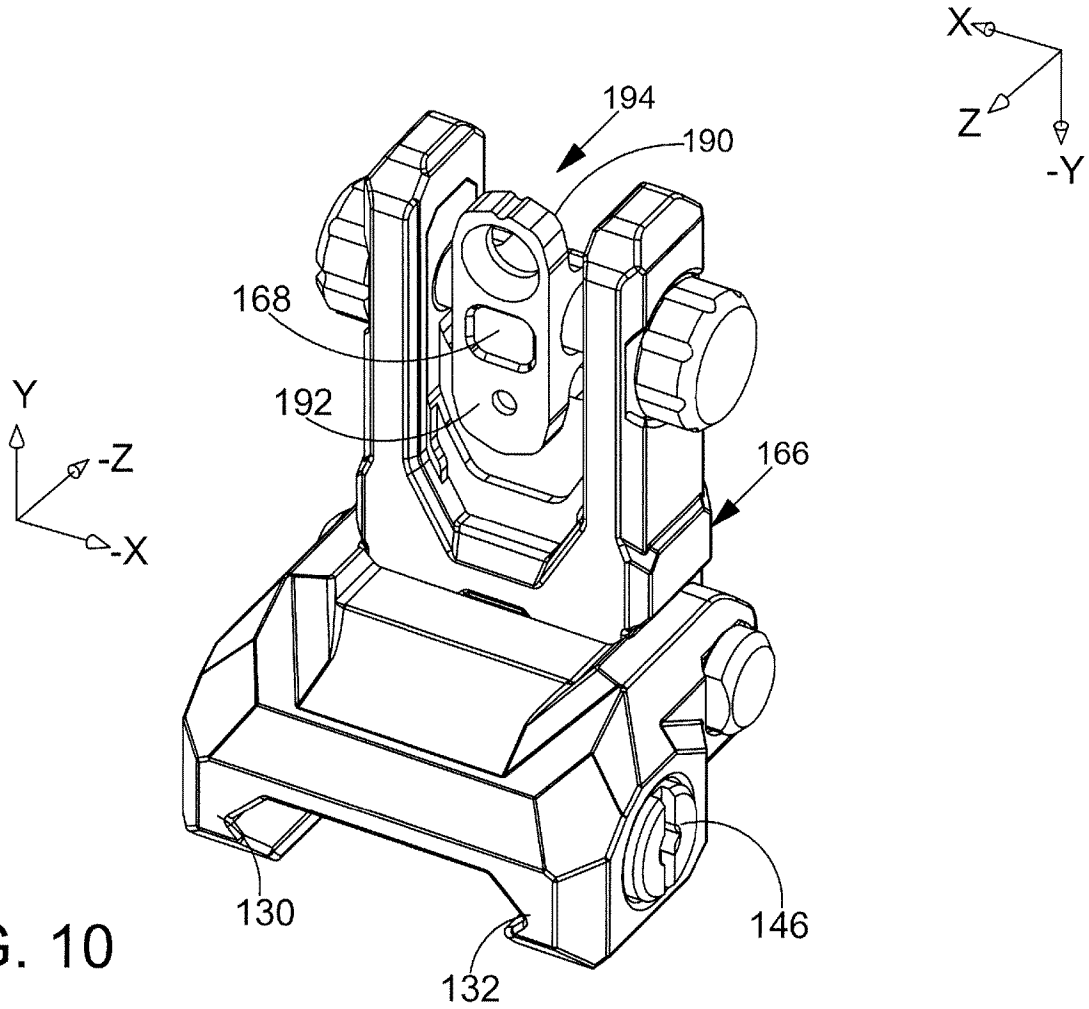
FIG. 10 is a perspective view illustrating additional sides of the rear sight shown in FIG.

Referring to FIG. 10, a perspective view illustrating additional sides of the rear sight 106 of FIG. 7 is shown. With reference to FIG. 10 it will be appreciated that the rear sight 106 is rotated approximately 180 degrees relative to the position of the rear sight 106 shown in FIG. 7. The rear sight 106 comprises a base 118 having two downwardly extending legs for coupling the base 118 to a mounting rail 198. The two downwardly extending legs of the base include a starboard side leg 130 and a port side leg 132. A bolt 146 extends through a port side hole defined by the port side leg 132 and a starboard side hole defined by the starboard side leg 130. Forces applied to the base 118 by the bolt 146 may deflect the base 118 so that the rear sight is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118. The base 118 of the rear sight 106 also includes a port side arm 128 and a starboard side arm 126 (seen in FIG. 7). A shaft 144 of the rear sight 106 may extend through the starboard side arm 126 of the base 118, the rear apertured sight assembly 166 and the port side arm 128 of the base 118. The shaft 144 of the rear sight 106 pivotally supports the rear apertured sight assembly 166 in the embodiment of FIG. 10.

Figure 11:
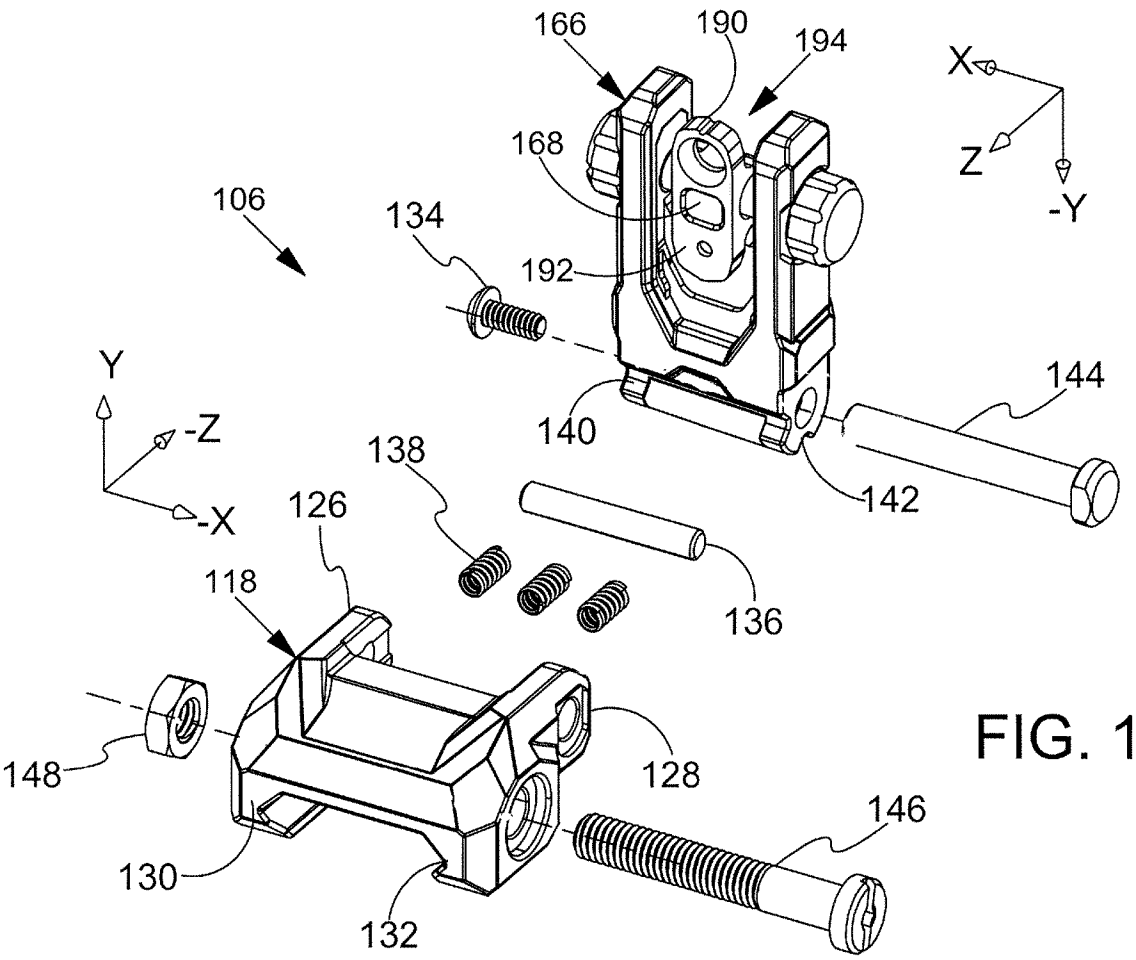
FIG. 11 is an exploded perspective view of the rear sight shown in FIG. 10.
Figure 12:
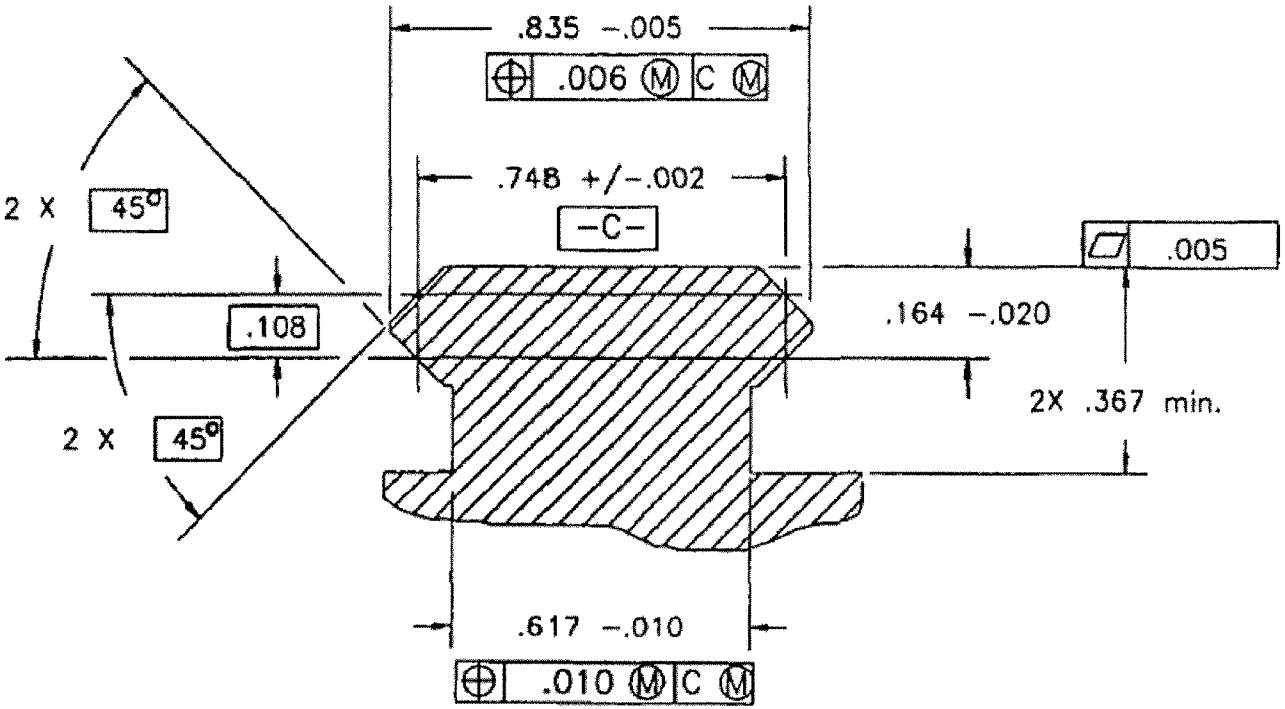
FIG. 12 PRIOR ART
FIG. 12 is a reproduction of a mounting rail drawing from Military Standard MIL-STD-1913 dated 3 Feb. 1995.
Figure 13A:
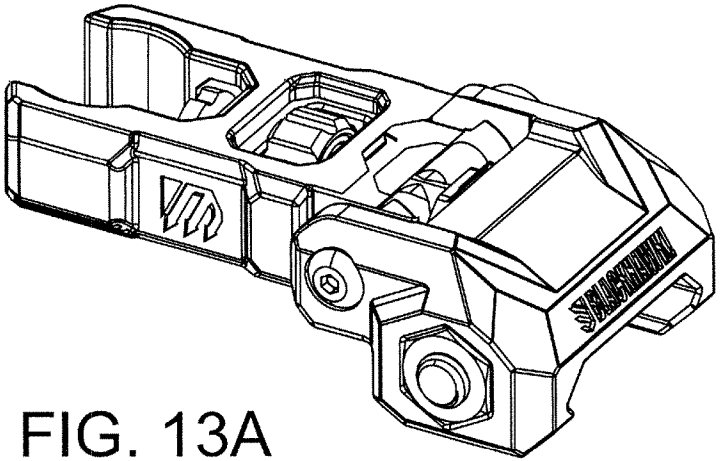
FIG. 13A and FIG. 13B are perspective views of a front sight.
Figure 13B:
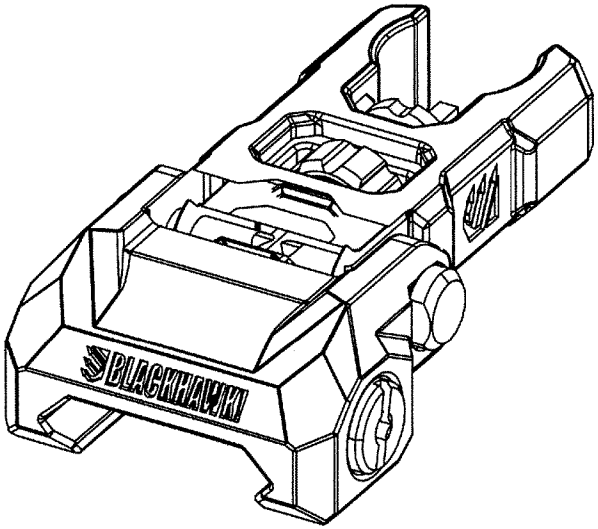
Figure 14A:
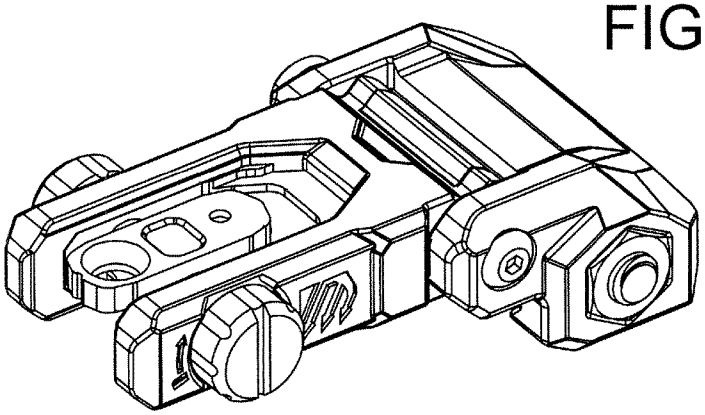
FIG. 14A and FIG. 14B are perspective views of a rear sight.
Figure 14B:
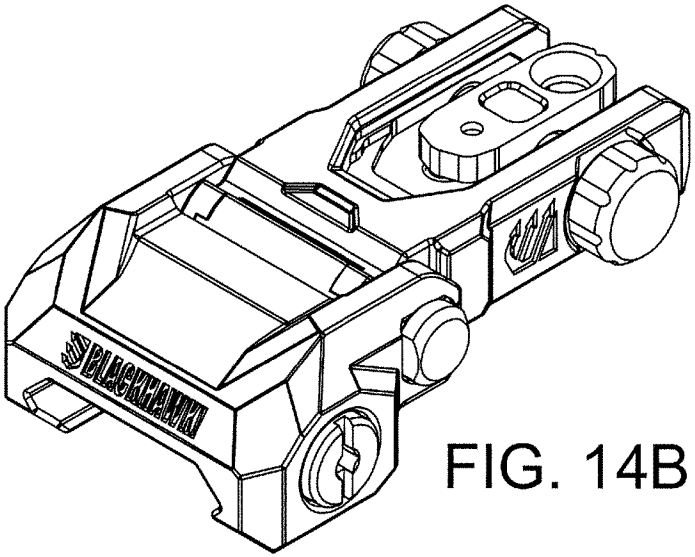

Referring to FIG. 11, an exploded perspective view of the rear sight 106 of FIG. 10 is shown. The rear sight 106 comprises a rear apertured sight assembly 166 and a base 118. The base 118 has two downwardly extending legs and two rearwardly extending arms. The two downwardly extending legs of the base include a starboard side leg 130 and a port side leg 132. A bolt 146 may extend through a port side hole defined by the port side leg 132 and a starboard side hole defined by the starboard side leg 130. The bolt 146 threadingly engages a nut 148. Forces applied to the base 118 by the bolt 146 and the nut 148 may deflect the base 118 so that the rear sight is selectively fixed at a desired location along a mounting rail 198. The base 118 may comprise a thermoplastic polymer material. In some useful embodiments, the base 118 the base comprises a thermoplastic polymer material with a level of flexibility selected so that forces applied to the base 118 by the bolt 146 and the nut 148 deflect the base 118.

Still referring to FIG. 11, the two rearwardly extending arms of the base include a starboard side arm 126 and a port side arm 128. A shaft 144 of the rear sight 106 may extend through the starboard side arm 126 of the base 118, the rear apertured sight assembly 166 and the port side arm 128 of the base 118. A retaining screw 134 may threadingly engage a threaded hole in the shaft 144 to prevent the shaft 144 from separating from the base 118 of the rear sight 106. The shaft 144, the starboard side arm 126 and the port side arm 128 may pivotally support a rear apertured sight assembly 166 when the rear sight 106 is in an assembled state.

Still referring to FIG. 11, the rear apertured sight assembly 166 is selectively pivotable about a sight post pivot axis PA between a deployed position and a reclined position. A rod 136 of the rear sight 106 is urged toward the rear apertured sight assembly 166 by three springs 138. The rear apertured sight assembly 166 defines a deployed position groove 140 and a reclined position groove 142. The rod 136 is received in the deployed position groove 140 when the rear apertured sight assembly 166 is in the deployed position. The rod 136 is received in the reclined position groove 142 when the rear apertured sight assembly 166 is in the reclined position.

Figure 15A:
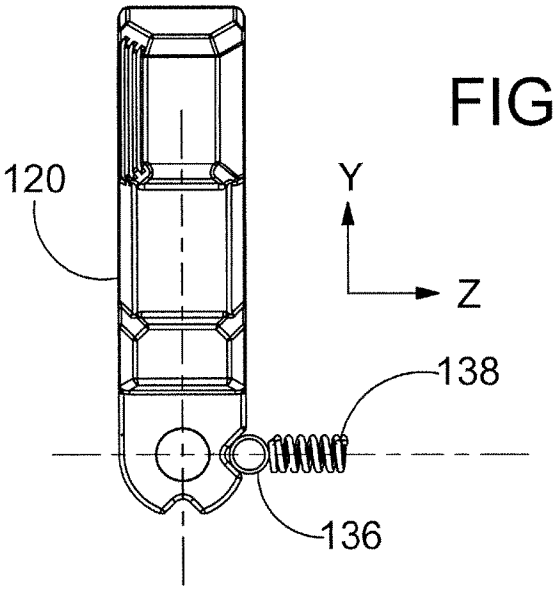
FIG. 15A is a diagram showing a front sight post assembly of a front sight. In the embodiment of FIG. 15A, the front sight post assembly is in a deployed position. In the diagram of FIG. 15A, a rod is being urged toward the front sight post of the front sight post assembly by a spring.

Referring to FIG. 15A, a diagram showing a front sight post assembly of a front sight is shown. In the embodiment of FIG. 15A, the front sight post assembly is in a deployed position. In the diagram of FIG. 15A, a rod is being urged toward the front sight post assembly by a spring. In FIG. 15A, a rearward portion of the rod can be seen extending into a deployed position groove defined by the front sight post.

Figure 15B:
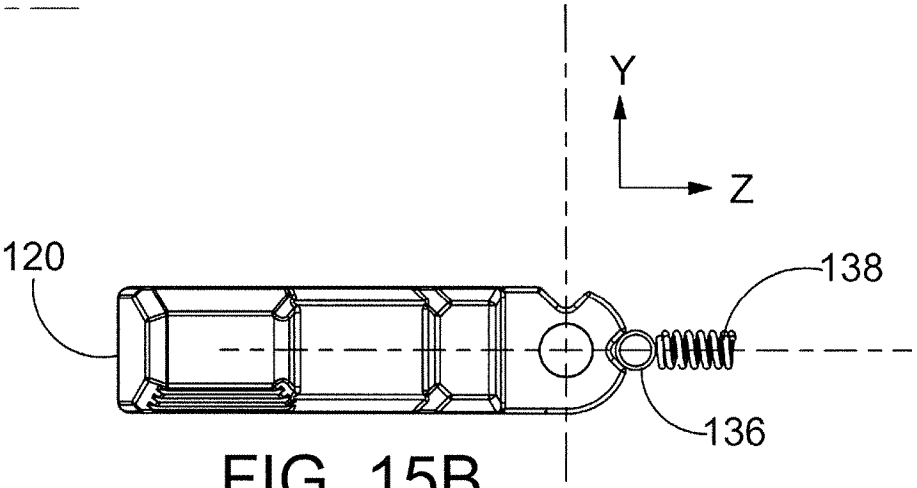
FIG. 15B is a diagram showing a front sight post assembly of a front sight. In the embodiment of FIG. 15B, the front sight post assembly is in a reclined position. In the diagram of FIG. 15B, a rod is being urged toward the front sight post of the front sight post assembly by a spring.
Figure 16A:
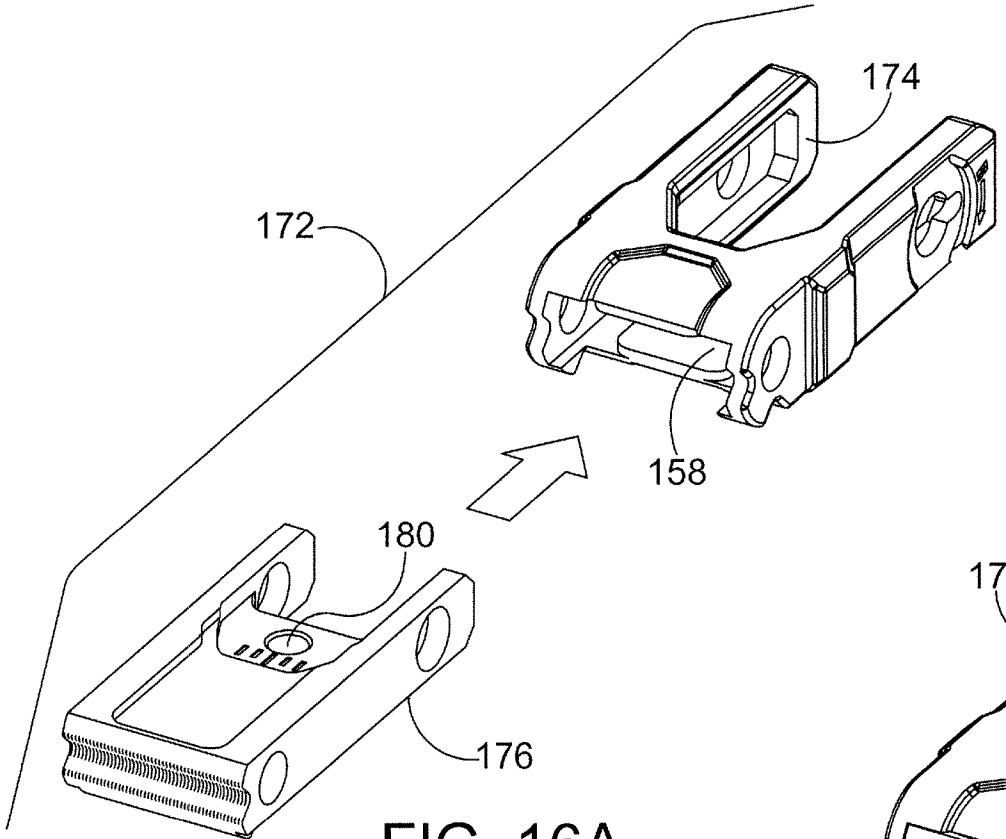
FIG. 16A is a exploded isometric view showing a rear metal insert and a rear polymer support body. A method in accordance with the disclosure may include inserting the rear metal insert into a cavity defined by the rear polymer support body.
Figure 16B:
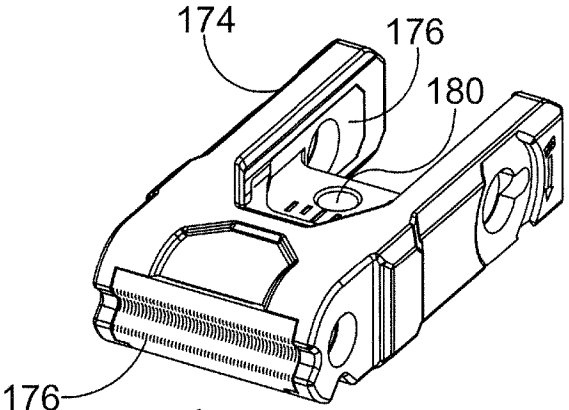
FIG. 16B is an isometric view showing an assembly including the rear metal insert and the rear polymer support body of FIG. 16A.
Figure 17B:
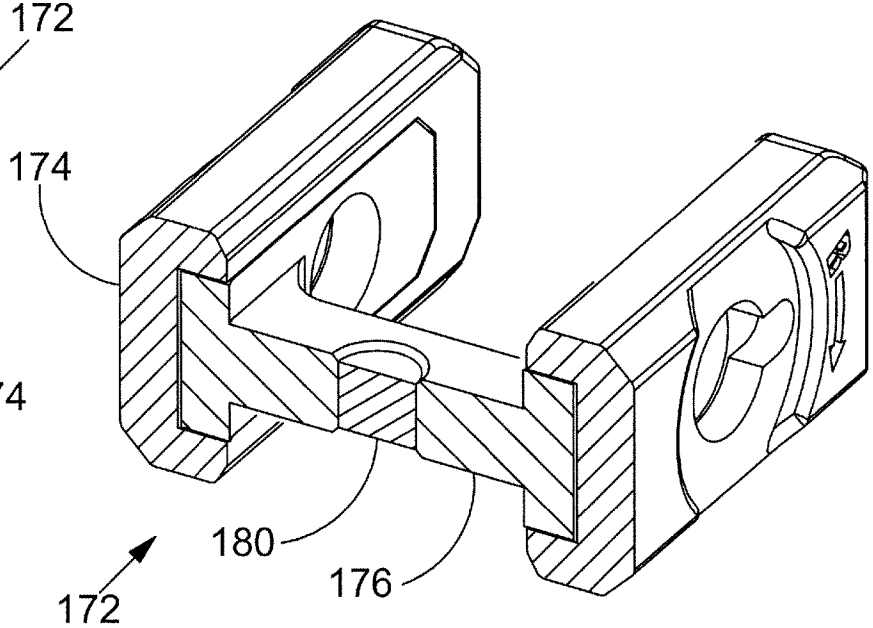
FIG. 17B is a cross-sectional view showing an assembly including the rear metal insert and the rear polymer support body of FIG. 17A. The cross-section of FIG. 17B has been taken along the section line B-B shown in FIG. 17A.
Figure 17A:
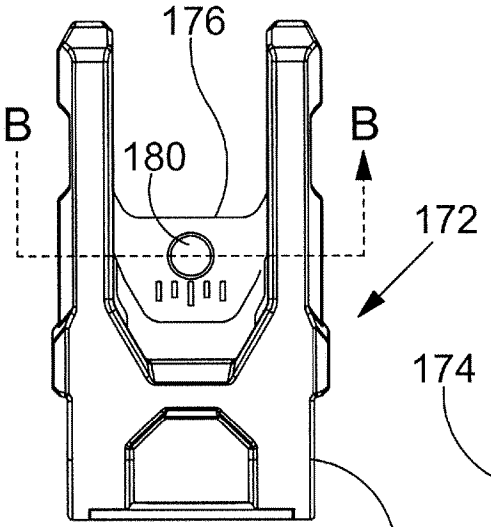
FIG. 17A is an elevation view of an assembly including a rear metal insert and a rear polymer support body.
Figures 18A, 18B:
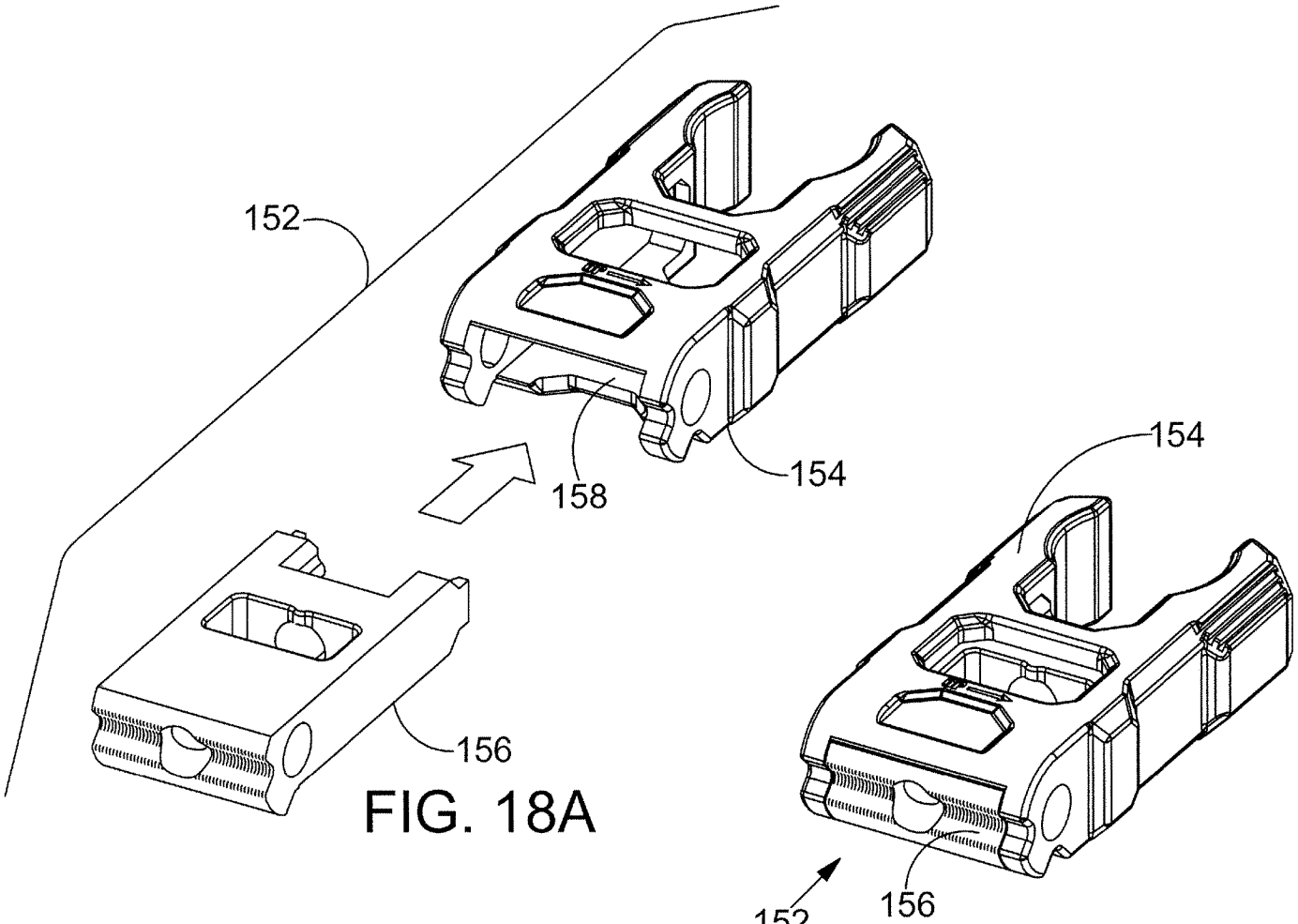
FIG. 18A is an exploded isometric view showing a front metal insert and a front polymer body. A method in accordance with the disclosure may include inserting the front metal insert into a cavity defined by the front polymer body.
FIG. 18B is an isometric view showing an assembly including the front metal insert and the front polymer body of FIG. 18A.
Figure 19B:
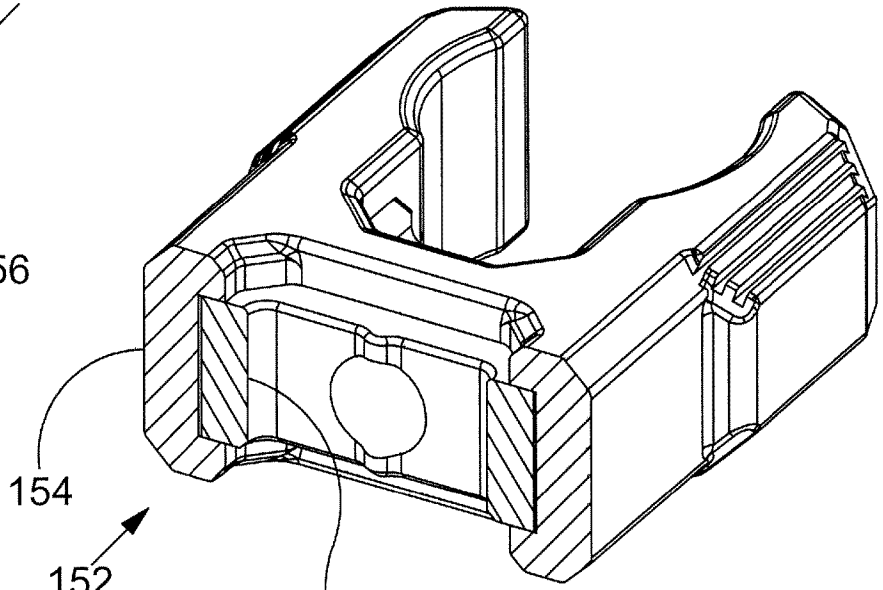
FIG. 19B is a cross-sectional view showing an assembly including the front metal insert and the front polymer body of FIG. 19A. The cross-section of FIG. 19B has been taken along the section line B-B shown in FIG. 19A.
Figure 19A:
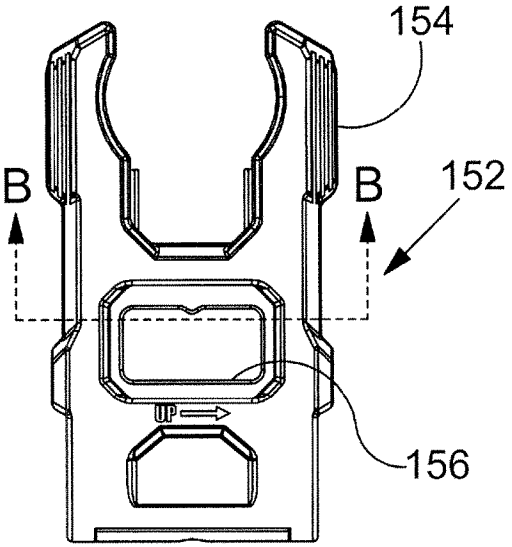
FIG. 19A is an elevation view of an assembly including a front metal insert and a front polymer body.
Figure 20A:
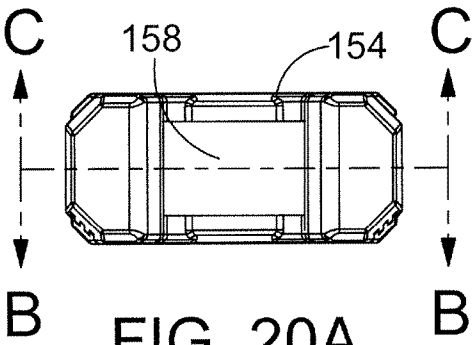
FIG. 20A is a top view of a polymer body for a front sight.
Figure 20B:
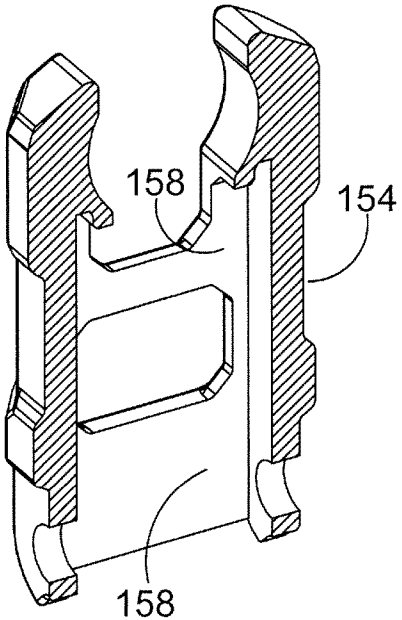
FIG. 20B is a cross-sectional perspective view of the polymer body shown in FIG. 20A. The polymer body shown in FIG. 20B has been cross-sectioned along the section line B-B shown in FIG. 20A.
Figure 20C:
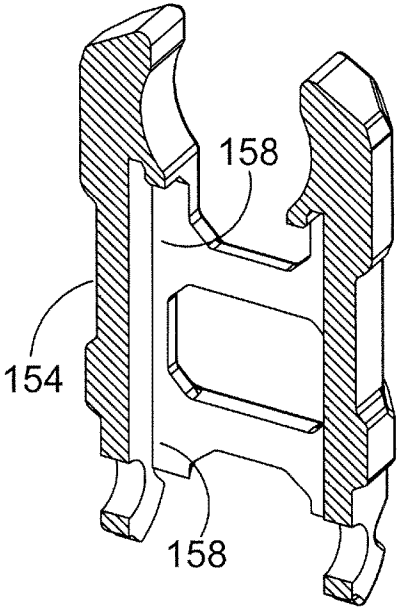
FIG. 20C is a cross-sectional perspective view of the polymer body shown in FIG. 20A. The polymer body shown in FIG. 20C has been cross-sectioned along the section line B-B shown in FIG. 20A.
Figure 21A:
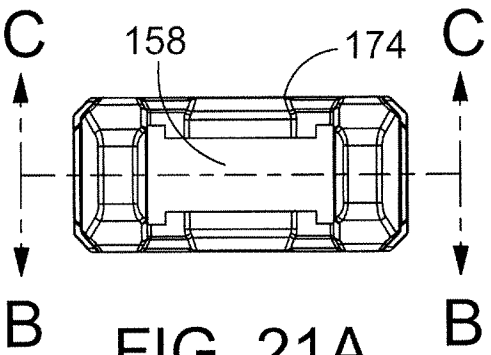
FIG. 21A is a top view of a polymer body for a front sight.
Figure 21B:
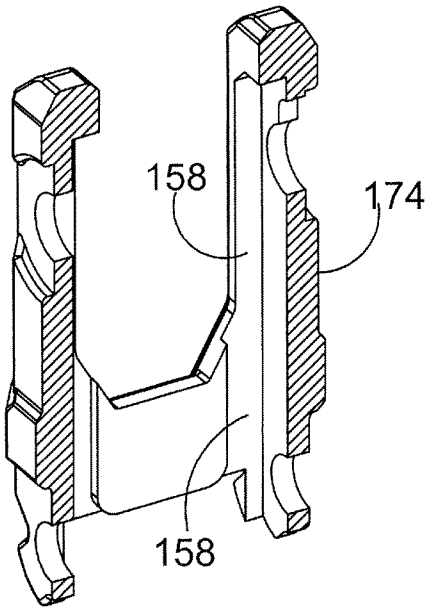
FIG. 21B is a cross-sectional perspective view of the polymer body shown in FIG. 21A. The polymer body shown in FIG. 21B has been cross-sectioned along the section line B-B shown in FIG. 21A.
Figure 21C:
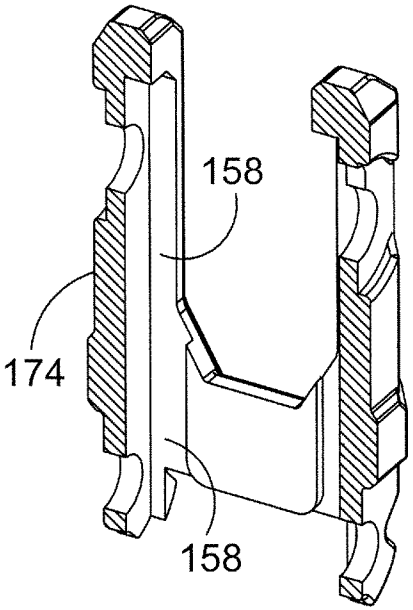
FIG. 21C is a cross-sectional perspective view of the polymer body shown in FIG. 21A. The polymer body shown in FIG. 21C has been cross-sectioned along the section line B-B shown in FIG. 21A.
Figure 22:
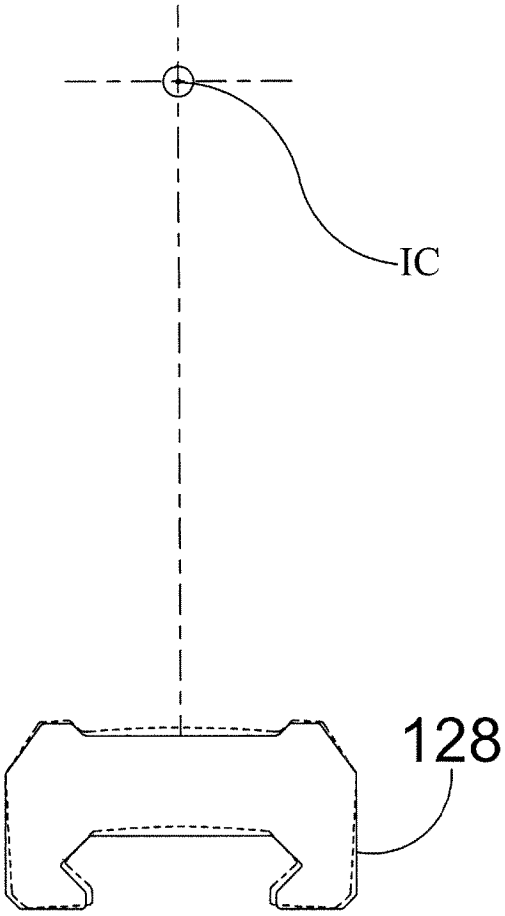
FIG. 22 PRIOR ART
FIG. 22 is a stylized diagram showing a base. In embodiments, the base is sufficiently flexible so that tightening of a mounting screw deflects the base, the port arm and the starboard arm pivoting about a virtual pivot point or instant center (IC) as the base is deflected by compressive forces produced by tightening of the mounting screw. The base of FIG. 22 may be the base of a front sight or the base of a rear sight. A deflected shape of the base is shown with dashed lines in FIG. 22. Solid lines are used to show the shape of the base when no external forces are acting on the base in FIG. 22.

Referring to FIG. 15B, a diagram showing a front sight post assembly of a front sight is shown. In the embodiment of FIG. 15B, the front sight post assembly is in a reclined position. In the diagram of FIG. 15B, a rod is being urged toward the front sight post of the front sight post assembly by a spring. In FIG. 15B, a rearward portion of the rod can be seen extending into a reclined position groove defined by the front sight post.

Referring to FIGS. 2 through 11, a forward direction Z and a rearward direction −Z are illustrated using arrows labeled "Z" and "−Z," respectively. A port direction X and a starboard direction −X are illustrated using arrows labeled "X" and "−X," respectively. An upward direction Y and a downward direction −Y are illustrated using arrows labeled "Y" and "−Y," respectively. The directions illustrated using these arrows may be conceptualized, by way of example and not limitation, from the point of view of a user holding a firearm in a normal firing position and viewing gunsights fixed to the firearm. The directions illustrated using these arrows may be applied to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to the ZX plane defined by the forward direction and the starboard direction. In one or more embodiments, the forward direction is generally opposite the rearward direction. In one or more embodiments, the forward direction and the rearward direction are both generally orthogonal to the XY plane defined by the upward direction and the starboard direction. In one or more embodiments, the starboard direction is generally opposite the port direction. In one or more embodiments, the starboard direction and the port direction are both generally orthogonal to the ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Referring to FIGS. 1 through 6, a front sight 104 for aiming a firearm 102 aiming a firearm 102 is provided. The firearm 102 has a barrel 108 defining a bore 110 extending along a gun bore axis 112. In FIG. 1, the gun bore axis 112 is shown extending in a forward direction and a rearward direction. The front sight 104 comprises a base 118 and a front sight post assembly 120. The base 118 may comprise two downwardly extending legs and two rearwardly extending arms. The two rearwardly extending arms may be arranged to pivotally support the front sight post assembly 120 so that the front sight post assembly 120 pivots about a front sight post pivot axis between a deployed position and a reclined position. The front sight post assembly 120 may comprise a front sight post 114. The front sight post 114 may comprise a front support body 154 defining a cavity 158 and a front post insert 156 disposed inside the cavity 158. The front post insert 156 and the front support body 154 may cooperate to define a deployed position groove 140. In embodiments, the deployed position groove 140 opens in the forward direction when the front sight post 114 is in the deployed position and the deployed position groove 140 opens in an upward direction when the front sight post 114 is in the reclined position. The front post insert 156 and the front support body 154 may also cooperate to define a reclined position groove 142. In embodiments, the reclined position groove 142 opens in the forward direction when the front sight post 114 is in the reclined position and the reclined position groove 142 opens in a downward direction when the front sight post 114 is in the deployed position. The front sight 104 may also include a rod 136 supported by the base 118. In embodiments, the rod 136 is urged toward the front sight post 114 by a plurality of springs 138. A rearward portion of the rod 136 may be received in the deployed position groove 140 when the front sight post assembly 120 is in the deployed position. The rearward portion of the rod 136 may be received in the reclined position groove 142 when the front sight post 114 is in the reclined position.

Referring to FIGS. 1 and 7-11, a rear sight 106 for aiming a firearm 102 aiming a firearm 102 is provided. The firearm 102 has a barrel 108 defining a bore 110 extending along a gun bore axis 112. In FIG. 1, the gun bore axis 112 is shown extending in a forward direction and a rearward direction. The rear sight 106 comprises a base 118 and a rear apertured sight assembly 166. The base 118 may comprise two downwardly extending legs and two rearwardly extending arms. The two rearwardly extending arms may be arranged to pivotally support the rear apertured sight assembly 166 so that the rear apertured sight assembly 166 pivots about a rear sight post pivot axis between a deployed position and a reclined position. The rear apertured sight assembly 166 may comprise a rear sight post 116. The rear sight post 116 may comprise a rear support body 174 defining a cavity 158 and a rear insert 176 disposed inside the cavity 158. The rear insert 176 and the rear support body 174 may cooperate to define a deployed position groove 140. In embodiments, the deployed position groove 140 opens in the forward direction when the rear sight post 116 is in the deployed position and the deployed position groove 140 opens in an upward direction when the rear sight post 116 is in the reclined position. The rear insert 176 and the rear support body 174 may also cooperate to define a reclined position groove 142. In embodiments, the reclined position groove 142 opens in the forward direction when the rear sight post 116 is in the reclined position and the reclined position groove 142 opens in a downward direction when the rear sight post 116 is in the deployed position. The rear sight 106 may also include a rod 136 supported by the base 118. In embodiments, the rod 136 is urged toward the rear sight post 116 by a plurality of springs 138. A rearward portion of the rod 136 may be received in the deployed position groove 140 when the rear apertured sight assembly 166 is in the deployed position. The rearward portion of the rod 136 may be received in the reclined position groove 142 when the rear sight post 116 is in the reclined position.

Referring to FIGS. 1 through 6, a front sight 104 for aiming a firearm 102 aiming a firearm 102 is provided. The firearm 102 has a barrel 108 defining a bore 110 extending along a gun bore axis 112. In FIG. 1, the gun bore axis 112 is shown extending in a forward direction and a rearward direction. The front sight 104 comprises a base 118 and a front sight post assembly 120. The base 118 may comprise two downwardly extending legs and two rearwardly extending arms. The two rearwardly extending arms may be arranged to pivotally support the front sight post assembly 120 so that the front sight post assembly 120 pivots about a front sight post pivot axis between a deployed position and a reclined position. The front sight post assembly 120 may comprise a front sight post 114. The front sight post 114 may comprise a front support body 154 defining a cavity 158 and a front post insert 156 disposed inside the cavity 158. The front sight post 114 may comprise a front sighting element 122 extending along a front sighting element axis 124. In embodiments, the front sighting element axis 124 extends in the forward and rearward directions when the front sight post assembly 120 is in the reclined position and the front sighting element axis 124 extends in the upward and downward directions when the front sight post assembly is in the deployed position. The base 118 may include a downward facing surface disposed between the two downwardly extending legs. The downward facing surface and the two downwardly extending legs may cooperate to define a mounting channel for receiving a dovetail shaped rail 198. The two downwardly extending legs may comprise a port side leg 132 and a starboard side leg 130. The front sight may include a bolt 146 extending through a port side hole defined by the port side leg 132 and a starboard side hole defined by the starboard side leg 130. In embodiments, the base 118 is sufficiently flexible so that tightening of the bolt 146 deflects the base 118. In embodiments, the port side arm 128 and the starboard side arm 126 pivot about a virtual pivot point as the base 118 is deflected by compressive forces produced by tightening of the bolt.

Referring to FIGS. 1 and 7-11, a rear sight 106 for aiming a firearm 102 aiming a firearm 102 is provided. The firearm 102 has a barrel 108 defining a bore 110 extending along a gun bore axis 112. In FIG. 1, the gun bore axis 112 is shown extending in a forward direction and a rearward direction. The rear sight 106 comprises a base 118 and a rear apertured sight assembly 166. The base 118 may comprise two rearwardly extending arms 126, 128. The two rearwardly extending arms arranged to pivotally support the rear sight portion 116 so that the rear sight portion pivots about a rear sight post pivot axis between a deployed position and a reclined position. The rear apertured sight assembly 166 may comprise a rear sight post 116. The rear sight post 116 may comprise a rear support body 174 defining a cavity 158 and a rear insert 176 disposed inside the cavity 158. The rear sight post 116 may comprise a rear sighting element 168. The base 118 may include a downward facing surface disposed between the two downwardly extending legs. The downward facing surface and the two downwardly extending legs may cooperate to define a mounting channel for receiving a dovetail shaped rail 198. The two downwardly extending legs may comprise a port side leg 132 and a starboard side leg 130. The rear sight may include a bolt 146 extending through a port side hole defined by the port side leg 132 and a starboard side hole defined by the starboard side leg 130. In embodiments, the base 118 is sufficiently flexible so that tightening of the bolt 146 deflects the base 118. In embodiments, the port side arm 128 and the starboard side arm 126 pivot about a virtual pivot point as the base 118 is deflected by compressive forces produced by tightening of the bolt.

Referring to FIGS. 8-10 and 16A-17B, in embodiments, a rear sight 106 comprises a base 118 having two downwardly extending legs 130,132 and two rearwardly extending arms 126, 128. In embodiments, the two rearwardly extending arms 126, 128 pivotally support a rear apertured sight assembly 166. In embodiments, the rear apertured sight assembly 166 is capable of pivoting about a rear apertured sight assembly pivot axis between a deployed position and a reclined position. In embodiments, the rear apertured sight assembly 166 comprises a rear sight post 116 including a rear polymer post body 174 defining a cavity 158 and a rear metal post insert 176 disposed inside the cavity 158. In embodiments, the rear apertured sight assembly 166 comprises a rear sighting element 168 defining a first aperture and a second aperture. In embodiments, the rear sighting element 168 is pivotally supported by the rear metal post insert 176 and/or the rear polymer post body 174. In embodiments, the rear sighting element 168 is free to pivot between a first position and a second position that is approximately 180 degrees different from the first position. In embodiments, the first aperture is located above the second aperture when the rear sighting element 168 is in the first position and the second aperture is located above the first aperture when the rear sighting element 168 is in the second position. In embodiments, the rear sight 106 comprises a magnet 180 disposed in a magnet bore 110 defined by the rear metal post insert 176. In embodiments, the magnet bore 110 opens in the forward and rearward directions. In embodiments, the magnet 180 is operable in the forward and rearward directions. In embodiments, the magnet 180 is positioned to selectively retain the rear sighting element 168 alternately in one of the first position and the second position.

The following United States patents are hereby incorporated by reference herein in accordance with MPEP 2163.07 (B) include: U.S. Pat. No. 4,686,770, U.S. Pat. No. 5,063,677, U.S. Pat. No. 5,533,292, U.S. Pat. No. 5,918,374, U.S. Pat. No. 6,732,467, U.S. Pat. No. 8,015,744, U.S. Pat. No. 8,037,634, U.S. Pat. No. 8,484,882, and U.S. Pat. No. 9,285,186. Components illustrated in such patents may be utilized with embodiments herein. The following United States patent application publications are hereby incorporated by reference herein: US20180003462 and US20180180386. Patents issuing from these published patent applications are also hereby incorporated by reference herein.

The patents and other references mentioned above in all sections of this application are herein incorporated by reference in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A backup sight system for attachment to a Picatinny rail, the backup sight system comprising a front sight with an adjustable elevation post and a rear sight with adjustable windage, the rear sight comprising:

a base with downwardly extending opposing polymer clamp portions for attachment to the Picatinny rail and a pair of forwardly or rearwardly extending arms;

a rear apertured sight assembly pivotally supported between the two forwardly or rearwardly extending arms of the base and pivoting about a rear apertured sight assembly pivot axis between an upright position and a reclined position;

the rear sight aperture assembly comprising a rear polymer support body having a U-shape and defining a slot, a rear metal insert with a U-shape disposed in the slot, and a rear sighting element having a first sight apertured portion and a second sight apertured portion, the rear sighting element being pivotally supported by a threaded rotatable shaft extending between two upper leg portions of the rear metal insert and two upper leg portions of the polymer body;

the rear sighting element pivotable between a first position with the first sight apertured portion upward and with the second sight apertured portion downward and a second position with the second sight apertured portion upward and with the first sight apertured portion downward, the rear sighting element moveable in a left or right direction within the rear polymer support body and the rear metal insert by rotational adjustment of the threaded shaft;

a magnet disposed in a magnet opening defined by the rear metal insert, the magnet operable in a forward and a rearward direction with respect to the rear metal insert, the magnet being positioned to selectively retain the rear sighting element alternately in one of the first position and the second position.

2. The system of claim 1 wherein rear sight aperture assembly pivot axis extends through a portion of the polymer body corresponding to a lower portion of the U-shape.

3. The system of claim 1 wherein the first sight apertured portion is 180 degrees from the second sight apertured portion.

4. The system of claim 1 further comprising a knob fixed to the threaded shaft, the knob forming part of an interference mechanism comprising a detent ball formed of an elastomeric material.

5. The system of claim 4 wherein the downwardly extending opposing polymer clamp portions are unitary.

6. The system of claim 1, wherein the front sight comprises a polymer base and a front sight post assembly pivotally connected thereto, the front sight post assembly comprising a polymer front support comprising a polymer front support body and a metal front insert nested therein.

7. The system of claim 6 wherein the front sight post assembly further comprises a front sighting element adjustable upwardly and downwardly in the metal insert by an elevation knob positioned in a window of the metal insert.

8. The system of claim 6, wherein the front sight includes an elevation mechanism for making elevation adjustments when sighting in the firearm, the elevation mechanism comprising a metal threaded member that can be rotated to raise and lower the adjustable elevation post.

9. A backup sight system for attachment to a firearm upper rail, the backup sight system comprising a front sight with an adjustable elevation post and a rear sight with adjustable windage, each of the front sight and rear sight having a base for clamping onto the firearm upper rail, each base having a pair of downwardly extending clamp portions, the downwardly extending clamp portions of each respective base are unitary with one another, each of the front and rear sights having a sight portion pivotal on the respective base between a deployed position and a reclined position, at least one of the front sight and rear sight comprising an exterior polymer support body with a U-shape, defining a slot, and having a pair of legs extending upwardly when said sight is in the deployed position, the at least one of the front sight and rear sight further comprising a U-shaped metal insert nested within the slot of the exterior polymer support portion, the U-shaped metal insert having a pair of legs extending upwardly when said sight is in the deployed position.

10. The backup sight system of claim 9 wherein both of the front sight and rear sight comprise an exterior polymer support body with a U-shape, define a slot, and have a pair of legs extending upwardly when said sight is in the deployed position, the front sight and rear sight further comprising a U-shaped metal insert nested within the slot of the exterior polymer support portion, the U-shaped metal insert having a pair of legs extending upwardly when said sight is in the deployed position.

11. The backup sight system of claim 10, wherein the metal insert of the front sight has a window extending therethrough with a rotary knob inserted therein for adjustment of a post.

12. The backup sight system of claim 10, wherein the exterior polymer support body and the metal insert of the rear sight both support a rear sighting element that has a pair of different sized sighting apertures, the rear sighting element supported by way of a threaded shaft extending through the rear sighting element and through the upwardly extending legs of the polymer support body and the metal insert.

13. The backup sight system of claim 12 wherein the metal insert further comprises a magnet and the rear sight element is attracted to the magnet whereby the magnet can hold the rear sight element in one of two positions, one position for sighting though each of the different sized sighting apertures.

14. A backup sight system for attachment to a Picatinny rail, the backup sight system comprising a front sight with an adjustable elevation post and a rear sight with adjustable windage, the front sight comprising:

a base with a pair of clamping portions for attachment to the Picatinny rail, a front sight post assembly comprising a U-shaped polymer support base and a U-shaped metal insert positioned in a slot in the U-shaped polymer support base, and a front sight post assembly pivotally connected to the metal insert, the front sight post assembly including a rotatable knob positioned in a window of the metal insert, the rotatable knob connecting to a threaded insert for moving the adjustable elevation post upwardly and downwardly.

15. The backup sight system for attachment to a Picatinny rail of claim 14 wherein the rear sight comprises:

a base with downwardly extending opposing polymer clamp portions for attachment to the Picatinny rail and a pair of forwardly or rearwardly extending arms;

a rear apertured sight assembly pivotally supported between the two forwardly or rearwardly extending arms of the base and pivoting about a rear apertured sight assembly pivot axis between an upright position and a reclined position;

the rear sight aperture assembly comprising a rear polymer support body having a U-shape and defining a slot, a rear metal insert with a U-shape disposed in the slot, and a rear sighting element having a first sight apertured portion and a second sight apertured portion, the rear sighting element being pivotally supported by a threaded rotatable shaft extending between two upper leg portions of the rear metal insert and two upper leg portions of the polymer body;

the rear sighting element pivotable between a first position with the first sight apertured portion upward and with the second sight apertured portion downward and a second position with the second sight apertured portion upward and with the first sight apertured portion downward, the rear sighting element moveable in a left or right direction within the rear polymer support body and the rear metal insert by rotational adjustment of the threaded shaft.

16. A backup sight system for attachment to a Picatinny rail of claim 15, further comprising a magnet disposed in a magnet opening defined by the rear metal insert, the magnet operable in a forward and a rearward direction with respect to the rear metal insert, the magnet being positioned to selectively retain the rear sighting element alternately in one of the first position and the second position.

17. The backup sight system of claim 15 wherein each base has a pair of unitary clamping portions.

18. The backup sight system of claim 15 further including a windage mechanism for making windage adjustments when sighting in the firearm, the windage mechanism comprising a threaded member that can be rotated to move a rear sighting element.

19. The rear sight of claim 18 further comprising a knob fixed to the threaded member, the knob forming part of an interference mechanism.

20. The rear sight of claim 19 wherein the interference mechanism comprises a detent ball, the detent ball comprising an elastomeric material.

* * * * *